US010124583B2

(12) United States Patent
Kumagai

(10) Patent No.: US 10,124,583 B2
(45) Date of Patent: Nov. 13, 2018

(54) LIQUID DISCHARGE APPARATUS AND LIQUID DISCHARGE SYSTEM

(71) Applicant: Seiko Epson Corporation, Tokyo (JP)

(72) Inventor: Shiki Kumagai, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/441,835

(22) Filed: Feb. 24, 2017

(65) Prior Publication Data

US 2017/0253030 A1 Sep. 7, 2017

(30) Foreign Application Priority Data

Mar. 3, 2016 (JP) ..... 2016-040737

(51) Int. Cl.
*B41J 2/045* (2006.01)

(52) U.S. Cl.
CPC ..... *B41J 2/04581* (2013.01); *B41J 2/0459* (2013.01); *B41J 2/04551* (2013.01); *B41J 2/04553* (2013.01); *B41J 2/04566* (2013.01); *B41J 2/04588* (2013.01); *B41J 2/04591* (2013.01); *B41J 2/04593* (2013.01); *B41J 2/04596* (2013.01)

(58) Field of Classification Search
CPC ..... B41J 2/0451; B41J 2/2139; B41J 2/2142; B41J 2/16579; B41J 2002/165
See application file for complete search history.

(56) References Cited

U.S. PATENT DOCUMENTS 5,541,628 A * 7/1996 Chang ..... B41J 2/04541 347/10
5,856,834 A 1/1999 Murphy
6,386,664 B1 * 5/2002 Hosono ..... B41J 2/04553 347/10

(Continued)

FOREIGN PATENT DOCUMENTS

CN 102756554 A 10/2012
EP 1 950 039 A1 7/2008

(Continued)

OTHER PUBLICATIONS

Extended European Search Report for Application No. EP 17 15 9269 dated Aug. 15, 2017 (8 pages).

(Continued)

*Primary Examiner* — Julian D Huffman
(74) *Attorney, Agent, or Firm* — Workman Nydegger

(57) ABSTRACT

A liquid discharge apparatus uses a drive signal including a micro-vibration waveform which causes the piezoelectric element to micro-vibrate such that an ink is not discharged from the nozzle in a case of being applied to the piezoelectric element as the drive signal and a drive waveform which deforms piezoelectric element such that the ink is discharged from the nozzle in a case of being applied to the piezoelectric element as the drive signal. The presentation unit selectably presents the indirect information from which the ink discharge status can be estimated such as the types of ink and the usage status of the ink or the like. The control unit changes the strength of the micro-vibration caused by the micro-vibration waveform based on the indirect information selected on the presentation unit.

11 Claims, 24 Drawing Sheets

(56) References Cited

U.S. PATENT DOCUMENTS 6,709,091 B1 * 3/2004 Takahashi ..... B41J 2/04581 347/71
6,742,859 B2 * 6/2004 Yonekubo ..... B41J 2/04536 347/11
2001/0003349 A1 * 6/2001 Hosono ..... B41J 2/04551 239/68
2001/0050696 A1 * 12/2001 Suzuki ..... B41J 2/04588 347/27
2002/0012017 A1 * 1/2002 Yonekubo ..... B41J 2/04551 347/10
2002/0140752 A1 * 10/2002 Pulman ..... B41J 2/04528 347/10
2003/0103096 A1 * 6/2003 Sayama ..... B41J 2/04581 347/9
2003/0146947 A1 * 8/2003 Ozaki ..... B41J 2/0458 347/11
2005/0275682 A1 12/2005 Seshimo
2007/0057979 A1 * 3/2007 Gardner ..... B41J 2/0456 347/5
2009/0231372 A1 * 9/2009 Shibata ..... B41J 2/04541 347/11
2009/0289976 A1 11/2009 Nishimura
2012/0274689 A1 11/2012 Zhang
2015/0217564 A1 * 8/2015 Koerner ..... B41J 2/04525 347/10
2017/0253030 A1 9/2017 Kumagai
2018/0086081 A1 3/2018 Sakamoto et al.

FOREIGN PATENT DOCUMENTS

JP 2005-280199 A 10/2005
JP 2009090533 4/2009
JP 2009-279816 A 12/2009
JP 2017154415 9/2017

OTHER PUBLICATIONS

Office Action issued in Application No. 15/703,181 dated Feb. 23, 2018.

* cited by examiner

| | SI (b1, b2, b3) | Sa | | | | |
|---|---|---|---|---|---|---|
| LARGE DOT | (1, 1, 1) | H | L | H | L | H |
| MIDDLE DOT | (1, 1, 0) | H | L | L | L | H |
| SMALL DOT | (1, 0, 1) | H | L | L | L | L |
| NON-RECORD 1 | (0, 1, 1) | L | H | L | H | L |
| NON-RECORD 2 | (0, 1, 0) | L | L | L | H | L |
| NON-RECORD 3 | (0, 0, 1) | L | H | L | L | L |

FIG. 22

| | PROBLEM STATE | |
|---|---|---|
| | AMOUNT OF DISCHARGE INCREASE | AMOUNT OF DISCHARGE SHORTAGE |
| CURRENT SETTING | | |
| NON-RECORD 3 | (NO MICRO-VIBRATION) | NON-RECORD 2 |
| NON-RECORD 2 | NON-RECORD 3 | NON-RECORD 1 |
| NON-RECORD 1 | NON-RECORD 2 | (FLUSHING) |

LIQUID DISCHARGE APPARATUS AND LIQUID DISCHARGE SYSTEM

BACKGROUND

1. Technical Field

The present invention relates to a liquid discharge apparatus and a liquid discharge system.

2. Related Art

A liquid discharge apparatus is an apparatus that includes a liquid discharge head which can discharge a liquid and discharges various liquids from the liquid discharge head. An ink jet printer that performs recording of an image or the like by discharging a liquid ink from nozzles of the liquid discharge head and landing the ink on a recording medium such as a recording sheet is included in examples of representative liquid discharge apparatus.

The liquid discharge head of the ink jet printer includes a cavity, nozzles communicating with the cavity, and a piezoelectric element that generates a pressure fluctuation on the ink in the cavity. By supplying the drive signal to the piezoelectric element, the piezoelectric element operates and the ink in the cavity is discharged from the nozzles as ink drops.

Because of the configuration as described above, in a case where the drive signal is not supplied to the piezoelectric element during a non-discharge period in which the ink is not discharged, the ink does not convect between the nozzles and the cavity, and thus, the ink in the vicinity of the nozzles is thickened during the non-discharge period.

Therefore, for example, as disclosed in JP-A-2005-280199, a technology is proposed, in which the drive signal is configured to include a drive pulse that discharges the ink and a micro-vibration pulse that micro-vibrating the ink in the vicinity of the nozzles to an extent that the ink is not discharged.

Amplitude or pulse widths of the drive pulse and the micro-vibration pulse described above are set based on an experiment using a standard type ink. The standard type ink is a genuine ink manufactured and managed by the manufacturer of the printer, and the manufacturer grasps the characteristics of the ink. Therefore, the amplitude or the pulse width of the drive pulse and the micro-vibration pulse can be appropriately set.

However, in some cases in a situation of actual use, from a viewpoint of diversification of color expression or the like, an ink other than the genuine ink is used in combination with the genuine ink. For example, in a case of only one color is a fluorescent color, there is a case where the ink of the fluorescent color is the ink other than the genuine ink. In such as case, the amplitude of the micro-vibration pulse wave set based on the genuine ink is not suitable for the ink other the genuine ink. As a result, an image density or the like is unstable in a case of continuous printing. In addition, in a case of performing an intermittent printing in which the printing is performed after a plurality of blank lines, missing of the images or the like has occurred.

SUMMARY

An advantage of some aspects of the invention is to provide a liquid discharge apparatus and a liquid discharge system in which the instability of the image at the time of the continuous printing and the missing of the images at the time of the intermittent printing or the like can be prevented from occurring even in a case where an ink other than the standard type ink is used.

According to an aspect of the invention, a liquid discharge apparatus includes: a piezoelectric element that is deformed when a drive signal is applied; a nozzle that discharges a liquid by the deformation of the piezoelectric element; a drive signal generation unit that generates a drive signal including a micro-vibration waveform which causes the piezoelectric element to micro-vibrate such that the liquid is not discharged from the nozzle in a case of being applied to the piezoelectric element as the drive signal and a drive waveform which deforms piezoelectric element such that the liquid is discharged from the nozzle in a case of being applied to the piezoelectric element as the drive signal; a presentation unit that selectably presents indirect information from which a liquid discharge status can be estimated; and a control unit that changes a strength of the micro-vibration caused by the micro-vibration waveform based on the indirect information selected on the presentation unit.

According to the aspect, the indirect information from which the liquid discharge status can be estimated is selectably presented by the presentation unit. When a user selects the indirect information based on this presentation, the control unit changes the strength of the micro-vibration caused by the micro-vibration waveform based on the indirect information selected by the presentation unit. Since the liquid discharge status can be estimated from the indirect information, it is possible to determine whether the influence of the micro-vibration caused by the micro-vibration waveform is in the direction of increasing the amount of discharge of the liquid or in the direction causing the shortage of the amount of discharge according to the estimated liquid discharge status. Therefore, in a case where the selection of the indirect information is performed when a liquid other than the standard liquid is used, and thus, the image defect occurs which is the result of discharging the liquid, the micro-vibration waveform is changed according to the liquid other than the standard liquid. That is, a residual vibration of the micro-vibration is changed according to the discharge status, and the micro-vibration is adjusted such that a nozzle missing or a printing deviation does not occur due to the influence to next print waveform. Therefore, even in a case where a liquid other than the standard liquid is used, the change of the strength of the micro-vibration which is relatively difficult to perform can be performed based on the indirect information easy to be understood by the users.

In the liquid discharge apparatus in the aspect described above, the presentation unit may present information that specifies types of the liquid as the indirect information from which the liquid discharge status. According to this aspect, it is possible to appropriately specify the liquid for which the strength of the micro-vibration caused by the micro-vibration waveform is to be changed.

In the liquid discharge apparatus in the aspect described above, the presentation unit may present information from which an amount degree of discharge of the liquid can be estimated, as the indirect information from which the liquid discharge status can be estimated. According to this aspect, in a case where the amount of discharge is determined to be in the direction of being increased from the amount degree of discharge that can be estimated, the strength of the micro-vibration caused by the micro-vibration waveform is changed in a direction to eliminate the increase of the amount of discharge. In addition, in a case where the amount of discharge is determined to be in the direction of causing the shortage from the amount degree of discharge that can be estimated, the strength of the micro-vibration caused by the micro-vibration waveform is changed in a direction to eliminate the shortage of the amount of discharge. As a result, the change of the strength of the micro-vibration which is relatively difficult to perform can be performed based on the indirect information easy to be understood by the users, from which the amount degree of discharge of the liquid can be estimated.

In the liquid discharge apparatus in the aspect described above, the presentation unit may present information relating to a frequency of using the liquid in a predetermined period as the indirect information from which the liquid discharge status can be estimated. According to this aspect, in a case where the amount of discharge is determined to be in the direction of being increased from the information relating to a frequency of using the liquid in a predetermined period, the strength of the micro-vibration caused by the micro-vibration waveform is changed in a direction to eliminate the increase of the amount of discharge. In addition, in a case where the amount of discharge is determined to be in the direction of causing the shortage from the information relating to the frequency of using the liquid in a predetermined period, the strength of the micro-vibration caused by the micro-vibration waveform is changed in a direction to eliminate the shortage of the amount of discharge. As a result, the change of the strength of the micro-vibration which is relatively difficult to perform can be performed based on the information easy to be understood by the users relating to the frequency of using the liquid in a predetermined period.

The liquid discharge apparatus in the aspect described above may further include a first liquid detection unit that detects that a liquid other than a standard liquid is used. In a case where the first liquid detection unit detects that a liquid other than the standard liquid is used, the presentation unit may selectably present the indirect information. According to this aspect, when the first liquid detection unit detects that a liquid other than the standard liquid is used, the indirect information is selectably presented on the presentation unit. Then, since the strength of the micro-vibration caused by the micro-vibration waveform is changed based on the selected indirect information, the strength of the micro-vibration is changed so as to become suitable for the liquid other than the standard liquid. Therefore, even in a case where the liquid other than the standard liquid is used, the strength of the micro-vibration is appropriately changed.

In the liquid discharge apparatus in the aspect described above, the presentation unit may selectably present information indicating the specific liquid as the indirect information from which the liquid discharge status can be estimated. According to this aspect, in a case where the information indicating the specific liquid is information indicating a liquid other than the standard liquid, the strength of the micro-vibration can be appropriately changed according to the liquid other than the standard liquid.

The liquid discharge apparatus in the aspect described above may further include a second liquid detection unit that detects a need for an exchange or a replenishment of the liquid. In a case where the need for the exchange or the replenishment of the liquid is detected by the second liquid detection unit, the presentation unit may selectably present the indirect information. According to this aspect, when the need for the exchange or the replenishment of the liquid is detected by the second liquid detection unit, the indirect information is selectably presented on the presentation unit. In a case where the exchange or the replenishment of the liquid is performed, there is a possibility that the liquid other than the standard liquid is used. However, in this aspect, the strength of the micro-vibration caused by the micro-vibration waveform can be changed based on the selected indirect information. Therefore, even in case where the liquid other than the standard liquid is used, the strength of the micro-vibration is changed so as to become suitable for the liquid other than the standard liquid. Therefore, even in a case where the liquid other than the standard liquid is used, the strength of the micro-vibration is appropriately changed.

In the liquid discharge apparatus in the aspect described above, the control unit may readably store information relating to the strength of the micro-vibration before the change. According to this aspect, in a case where the changed strength of the micro-vibration is returned to the original, the stored information relating to the strength of the micro-vibration before the change is read, and the strength of the micro-vibration is set based on the read information. Therefore, even in a case where the image defect is not eliminated by the change of the strength of the micro-vibration, the changed strength of the micro-vibration can easily be returned to the original.

The liquid discharge apparatus in the aspect described above may further include a detection unit that detects a change in the external environment. The control unit may change the strength of the micro-vibration caused by the micro-vibration waveform according to the change in the external environment detected by the detection unit. According to this aspect, in a case where the changes in the external environment are detected by the detection unit that detects the changes in the external environment, there is a possibility that the viscosity characteristics of the liquid may be changed. However, since the control unit changes the strength of the micro-vibration caused by the micro-vibration waveform according to the detected changes in the external environment, the strength of the micro-vibration is appropriately changed.

The liquid discharge apparatus in the aspect described above may further include an identification unit that identifies a user. The presentation unit may appropriately switch the presented indirect information according to the user identified by the identification unit. In a case where the liquid discharge apparatus is used by a plurality of users, it is considered that a specific liquid is used depending on the user. However, according to this aspect, since the presented indirect information is switched according to the user identified by the identification unit, the liquid used by each user can appropriately be specified, and the strength of the micro-vibration can appropriately be changed according to the liquid.

According to another aspect of the invention, a liquid discharge system includes: a liquid discharge apparatus; and an information processing system capable of communicating with the liquid discharge apparatus. The liquid discharge apparatus includes a piezoelectric element that is deformed when a drive signal is applied, a nozzle that discharges a liquid by the deformation of the piezoelectric element, a drive signal generation unit that generates a drive signal including a micro-vibration waveform which causes the piezoelectric element to micro-vibrate such that the liquid is not discharged from the nozzle in a case of being applied to the piezoelectric element as the drive signal and a drive waveform which deforms piezoelectric element such that the liquid is discharged from the nozzle in a case of being applied to the piezoelectric element as the drive signal, and a control unit that changes a strength of the micro-vibration caused by the micro-vibration waveform based on the indirect information output from the information processing system. The information processing system includes a presentation unit that selectably presents indirect information as the indirect information from which a liquid discharge status can be estimated, and an output unit that outputs the indirect information selected on the presentation unit to the liquid discharge apparatus.

According to this aspect, the indirect information from which the liquid discharge status can be estimated is selectably presented by the presentation unit of the information processing system. When the user selects the indirect information based on the presentation, the output unit of the information processing system outputs the selected indirect information to the liquid discharge apparatus. The control unit of the liquid discharge apparatus changes the strength of the micro-vibration caused by the micro-vibration waveform based on the indirect information output from the information processing system. Since the liquid discharge status can be estimated from the indirect information, it is possible to determine whether the influence of the micro-vibration caused by the micro-vibration waveform is in the direction of increasing the amount of discharge of the liquid or in the direction causing the shortage of the amount of discharge according to the estimated liquid discharge status. Therefore, in a case where the selection of the indirect information is performed when a liquid other than the standard liquid is used, and thus, the image defect occurs which is the result of discharging the liquid, the micro-vibration waveform is changed according to the liquid other than the standard liquid. That is, a residual vibration of the micro-vibration is changed according to the discharge status, and the micro-vibration is adjusted such that a nozzle missing or a printing deviation does not occur due to the influence to next print waveform. Therefore, even in a case where a liquid other than the standard liquid is used, the change of the strength of the micro-vibration which is relatively difficult to perform can be performed based on the indirect information easy to be understood by the users.

BRIEF DESCRIPTION OF THE DRAWINGS

The invention will be described with reference to the accompanying drawings, wherein like numbers reference like elements.

FIG. 22 is a diagram for explaining an order of changing a selection pattern of a micro-vibration waveform.

DESCRIPTION OF EXEMPLARY EMBODIMENTS

Hereinafter, embodiments of the invention will be described with reference to drawings. However, in each drawing, the dimension or scale of each unit may be different from the actual one. Since the embodiments described below are preferred specific examples of the invention, various technical limitations are appeared as specific preferable examples of the invention. However, the scope of the invention is not limited by these embodiments unless otherwise particularly stating the limitation in the description below.

A. First Embodiment

In the present embodiment, an ink jet type serial printer that discharges an ink (an example of "liquid") and forms an image on a fibrous medium such as cloth is described as an example of a liquid discharge apparatus.

Figure 1:
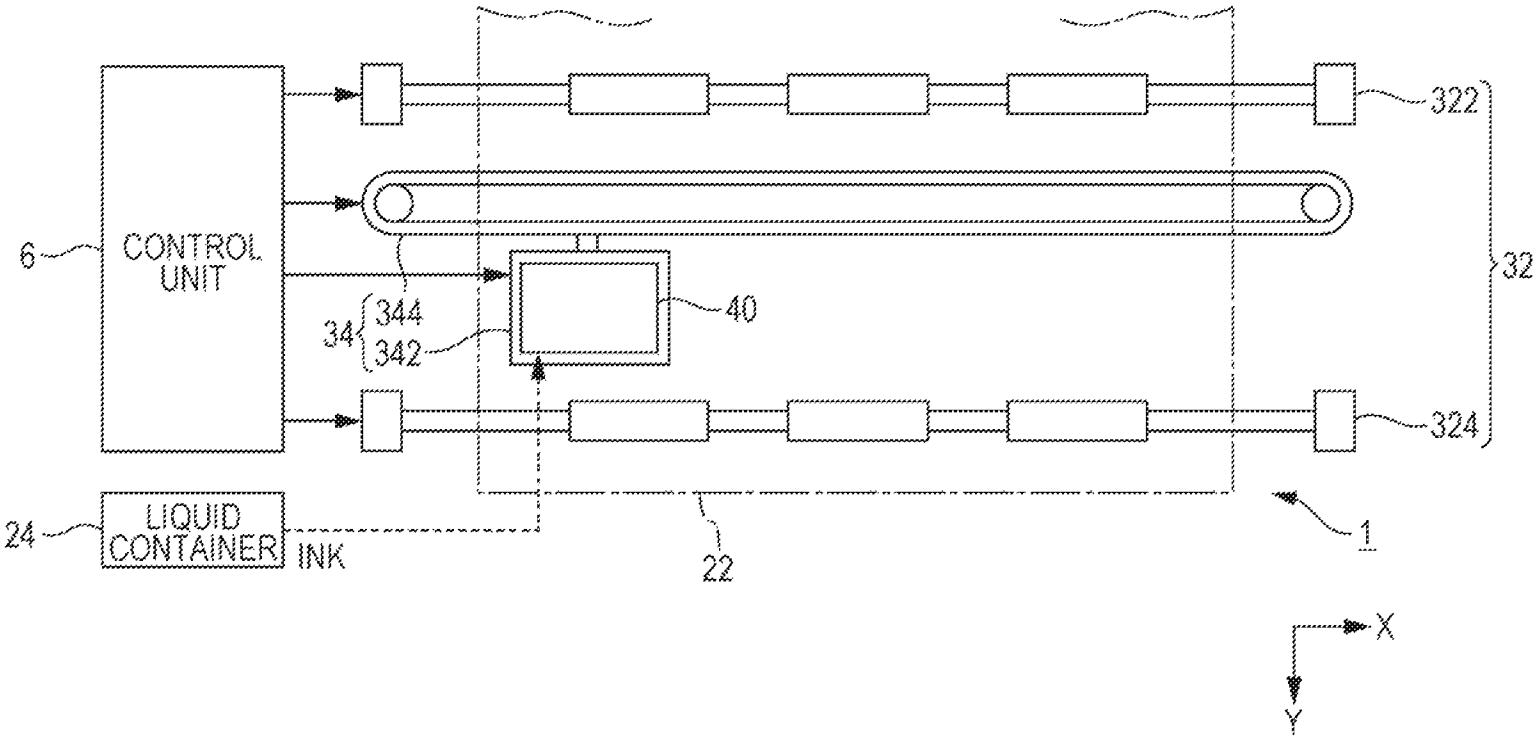
FIG. 1 is a schematic cross-sectional view of the main part of the ink jet printer.

FIG. 1 is a partial configuration diagram of an ink jet printer 1 in the present embodiment. The ink jet printer 1 in the present embodiment is an ink jet type printing apparatus that ejects an ink suitable for textile printing on the fibrous medium 22 such as the cloth. For example, a liquid container 24 that stores the ink is fixed to the ink jet printer 1. For example, a cartridge attachable and detachable to and from the ink jet printer 1, a bag-like ink pack form in a flexible film, or an ink tank capable of refilling the ink can be used as the liquid container 24. The multiple types of ink having various colors are stored in the liquid container 24.

Figure 2:
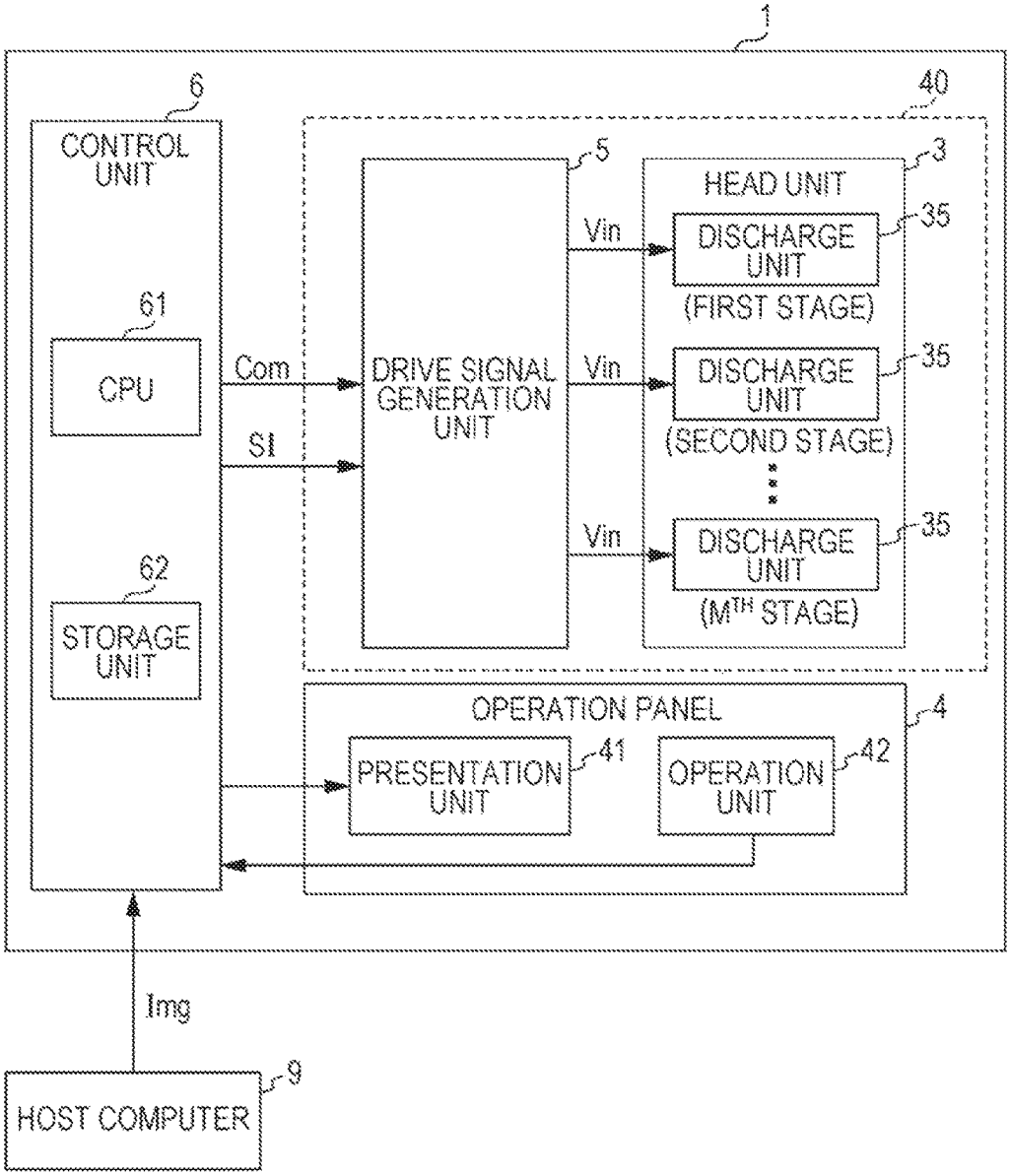
FIG. 2 is a block diagram illustrating a configuration of an ink jet printer in a first embodiment of the invention.

As illustrated in FIG. 2, the ink jet printer 1 includes a control unit 6, a transport mechanism 32, a movement mechanism 34, and a liquid ejecting unit 40. The control unit 6 is configured to include, for example, a central processing unit (CPU) and a storage unit such as a semiconductor memory, and performs overall controls of each unit of the ink jet printer 1 by the CPU executing a program stored in the storage unit. The control unit 6 may use a field programmable gate array (FPGA) or the like.

The transport mechanism 32 transports the medium 22 to the Y direction based on the control by the control unit 6. The transport mechanism 32 in the present embodiment includes a feed roller 322 and a discharge roller 324. The feed roller 322 is installed on upstream side (negative side in the Y direction) of the discharge roller 324 and transports the medium 22 to the discharge roller 324 side, and the discharge roller 324 transports the medium 22 fed from the feed roller 322 to the downstream side (positive side in Y direction). The structure of the transport mechanism 32 is not limited to the example described above.

The movement mechanism 34 is a mechanism that reciprocates the liquid ejecting unit 40 in the X direction based on the control by the control unit 6. The X direction in which the liquid ejecting unit 40 reciprocates is a direction crossing (typically, orthogonal) to the Y direction in which the medium 22 is transported. The movement mechanism 34 in the present embodiment includes a carriage 342 and a transport belt 344. The carriage 342 has a box shaped structure to support the liquid ejecting unit 40 and is fixed to the transport belt 344. The transport belt 344 is an endless belt longitudinally provided in the X direction. The liquid ejecting unit 40 reciprocates in the X direction together with the carriage 342 by the rotation of the transport belt 344 based on the control by the control unit 6. The structure of the movement mechanism 34 is not limited to the example described above. In addition, the liquid container 24 can be mounted on the carriage 342 together with the liquid ejecting unit 40.

In the present embodiment, four liquid containers 24 are provided, and each liquid container 24 is respectively filled with yellow, cyan, magenta, and black ink. The ink jet printer 1 in the present embodiment includes four liquid containers 24 corresponding to the ink of four colors, but the invention is not limited to the aspect. Three or less or five or more liquid containers 24 corresponding to the ink of three or less or five or more colors may be provided. In addition, the liquid container 24 filled with the ink of colors other than the four colors may be provided, and only the liquid container 24 corresponding to a part of the color among the four colors may be provided. That is, the ink jet printer in the invention may be a printer that can discharge the ink of as long as one or more colors.

The liquid ejecting unit 40 ejects the ink supplied from the liquid container 24 on the medium 22 based on the control by the control unit 6. A desired image is formed on the medium 22 by the liquid ejecting unit 40 ejecting the ink on the medium 22 in parallel with the transportation of the medium 22 by the transport mechanism 32 and the repeated reciprocation of the carriage 342.

FIG. 2 is a functional configuration diagram of the ink jet printer 1. The transport mechanism 32, the movement mechanism 34, or the like are omitted to be illustrated for the convenience. As illustrated in FIG. 2, the control unit 6 in the present embodiment controls a drive signal generation unit 5, the transport mechanism 32, and the movement mechanism 34 based on image data Img input from a host computer 9 such as a personal computer or a digital camera.

As illustrated in FIG. 2, the control unit 6 includes a CPU 61 and a storage unit 62. The storage unit 62 includes an electrically erasable programmable read-only memory (EEPROM), a random access memory (RAM), and a PROM. The EEPROM is a kind of a nonvolatile semiconductor memory that stores the image data Img supplied from the host computer 9 via an interface (not illustrated) in a data storage region. The RAM is a memory that temporarily stores data necessary for executing various processing items such as print processing or temporarily deploys a control program for executing the various processing items such as the print processing. The PROM is a kind of a nonvolatile memory that stores the control program for controlling each unit of the ink jet printer 1.

The CPU 61 stores the image data Img supplied from the host computer 9 in the storage unit 62. In addition, the CPU 61 controls an operation of the drive signal generation unit 5 and generates signals such as a print signal SI for driving the discharge unit 35 and a drive waveform signal Com based on various data items such as the image data Img stored in the storage unit 62. Furthermore, the CPU 61 generates various signals such as the control signals for controlling the operation of the transport mechanism 32 and the movement mechanism 34 based on various data items stored in the storage unit 62.

As illustrated in FIG. 2, the liquid ejecting unit 40 in the present embodiment includes the drive signal generation unit 5 and a head unit 3, and outputs the generated various signals. The drive signal generation unit 5 supplies the drive signal Vin to the head unit 3 based on the control by the control unit 6.

As illustrated in FIG. 2, the head unit 3 includes M (M is a natural number equal to or larger than four) discharge units 35 corresponding to the nozzles N (refer to FIG. 3) different from each other. Hereinafter, in order to distinguish each of the M discharge units 35, some times, each discharge unit will be referred to as a first stage, a second stage, . . . , an Mth stage in an order. The head unit 3 ejects the ink in response to the drive signal Vin supplied from the drive signal generation unit 5. Each of the M discharge units 35 receives the ink from any one of the four liquid containers 24.

The drive signal generation unit 5 in the present embodiment generates a drive signal Vin for driving each of the M discharge units 35 included in the head unit 3 based on the print signal SI and the drive waveform signal Com supplied from the control unit 6. The details of the print signal SI, the drive waveform signal Com, and the drive signal Vin will be described below.

As illustrated in FIG. 2, the ink jet printer 1 includes an operation panel 4. The operation panel 4 includes a presentation unit 41 and an operation unit 42. The presentation unit 41 is configured with, for example, a liquid crystal display, an organic EL display, or an LED lamp, and presents indirect information or the like for adjusting a below-described micro-vibration waveform. The operation unit 42 is configured with various switches or the like.

Figure 3:
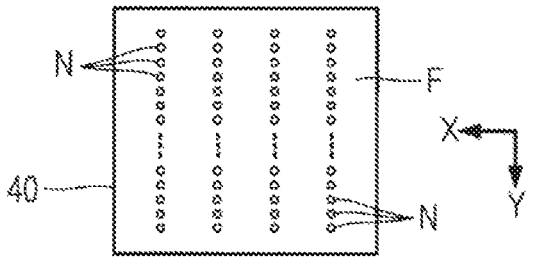
FIG. 3 is a plan view of a surface facing a medium in a head unit.

FIG. 3 is a plan view of a surface (hereinafter, referred to as an "ejection surface") F facing the medium 22 in the head unit 3. As illustrated in FIG. 3, multiple nozzles N are formed on the ejection surface F. Specifically, multiple nozzle columns corresponding to the ink of the colors different from each other are provided in the X direction with gaps from each other, and each of the multiple nozzle columns are configured with multiple nozzles N arrayed in the Y direction. An arbitrary one nozzle column may be multiple arrays of the nozzles N (for example, a zigzag array or a staggered array).

Figure 4:
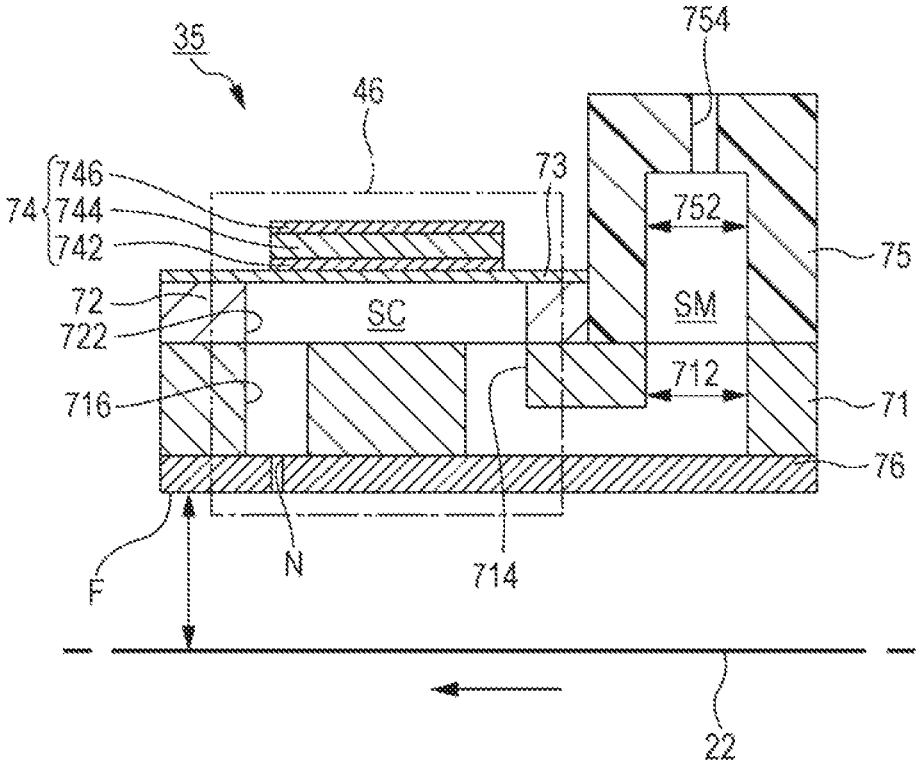
FIG. 4 is a schematic cross-sectional view of the main part of the head unit.

FIG. 4 is a cross-sectional diagram focusing on an arbitrary discharge unit 35 in the head unit 3. As illustrated in FIG. 4, the head unit 3 has a structure in which a cavity substrate 72, a vibration plate 73, a piezoelectric element 74, and a supporter 75 are disposed on one side of a flow path substrate 71 and a nozzle plate 76 is disposed on the other side of the flow path substrate 71. The flow path substrate 71, the cavity substrate 72, and the nozzle plate 76 are formed from a silicon plate material and the supporter 75 is formed from by an injection molding of a resin material.

The multiple nozzles N are formed on the nozzle plate 76. A surface on the nozzle plate 76 in the opposite side of the flow path substrate 71 corresponds to the ejection surface F.

An opening portion 712, a branch flow path (throttle flow path) 714, and a communication flow path 716 are formed on the flow path substrate 71. The branch flow paths 714 and the communication flow paths 716 are through holes formed for each nozzle N, and the opening portion 712 is an opening continuous over the multiple nozzles N. A space that mutually communicates a housing portion (a concave portion) 752 formed on the supporter 75 and the opening portion 712 of the flow path substrate 71 functions as a common liquid chamber (a reservoir) SM for storing the ink supplied from the liquid container 24 via an introduction flow path 754 on the supporter 75.

Opening portions 722 are formed on the cavity substrate 72 for each nozzle N. The vibration plate 73 is an elastically deformable plate material installed on the cavity substrate 72 on the surface opposite to the flow path substrate 71 side. A space interposed between the vibration plate 73 and the flow path substrate 71 inside of each opening portions 722 on the cavity substrate 72 functions as a cavity SC which is filled with the ink supplied from the common liquid chamber SM via the branch flow path 714. Each cavity SC communicates with the nozzles N via the communication flow path 716 on the flow path substrate 71.

The piezoelectric elements 74 are formed on the vibration plate 73 on the surface opposite to the cavity substrate 72 side for each nozzle N. Each piezoelectric element 74 is a driving element in which a piezoelectric body 744 is interposed between the first electrode 742 and the second electrode 746. One discharge unit 35 illustrated in FIG. 2 is a portion in which the piezoelectric element 74, the vibration plate 73, the cavity SC, and the nozzle N are included. The drive signal Vin from the drive signal generation unit 5 is supplied to any one of the first electrode 742 and the second electrode 746 of the piezoelectric element 74, and the reference electric potential V0 is supplied to the other side of the first electrode 742 and the second electrode 746. When the vibration plate 73 vibrates due to the deforms of the piezoelectric element 74 by the supply of the drive signal Vin, the pressure in the cavity SC, and thus, the ink in the cavity SC is ejected from the nozzle N. Specifically, the piezoelectric element 74, in the present embodiment operates in such a manner that the volume of the cavity SC increases (the pressure decreases) when the voltage lower than the reference electric potential V0 is supplied, and the volume of the cavity SC decreases (the pressure increases) when the voltage higher than the reference electric potential V0 is supplied.

Next, the ink discharging operation in the discharge unit 35 will be described with reference to FIG. 5A to FIG. 5C.

Figure 5A:
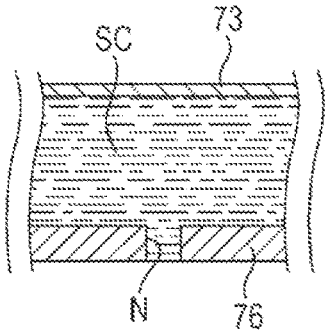
FIG. 5A is an explanatory diagram for explaining a change of a sectional shape of a discharge unit when a drive signal is supplied.
Figure 5B:
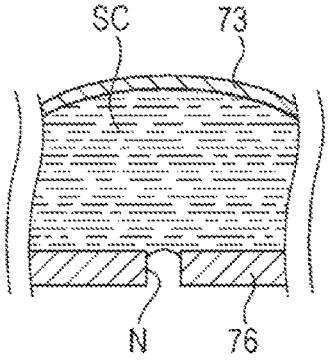
FIG. 5B is an explanatory diagram explaining a change of the sectional shape of the discharge unit when the drive signal is supplied.

When the drive signal Vin is supplied to the piezoelectric element 74 from the drive signal generation unit 5, a distortion proportional to the voltage (an electric field generated between the electrodes) applied between the electrodes is generated, and the vibration plate 73 is bent upward as illustrated in FIG. 5B with respect to the initial state illustrated in FIG. 5A. As a result, the volume of the cavity SC increases as illustrated in FIG. 5B. In this state, when the voltage indicated by the drive signal Vin is changed according to the control by the drive signal generation unit 5, the vibration plate 73 is restored due to the elastic restoring force. Then, the vibration plate 73 moves downward beyond the position of the vibration plate 73 in the initial state, and the volume of the cavity SC sharply shrinks as illustrated in FIG. 5C. At this time, due to the compression pressure generated in the cavity SC, part of the ink filling the cavity SC is discharged from the nozzles N communicated with the cavity SC as ink drops.

In the vibration plate 73 of each cavity SC, during a time from completion of a series of ink discharging operations to the start of next ink discharging operation, a damped vibration, that is, a residual vibration occurs. It is assumed that the residual vibration of the vibration plate 73 has a natural vibration frequency that is determined according to an acoustic resistance due to a shape of the nozzles N and the communication flow path 716 or an ink viscosity, an inertance due to an ink weight in the flow path, and a compliance of the vibration plate 73.

Next, a configuration and an operation of the drive signal generation unit 5 will be described with reference to FIG. 6 to FIG. 8.

Figures 6, 7:
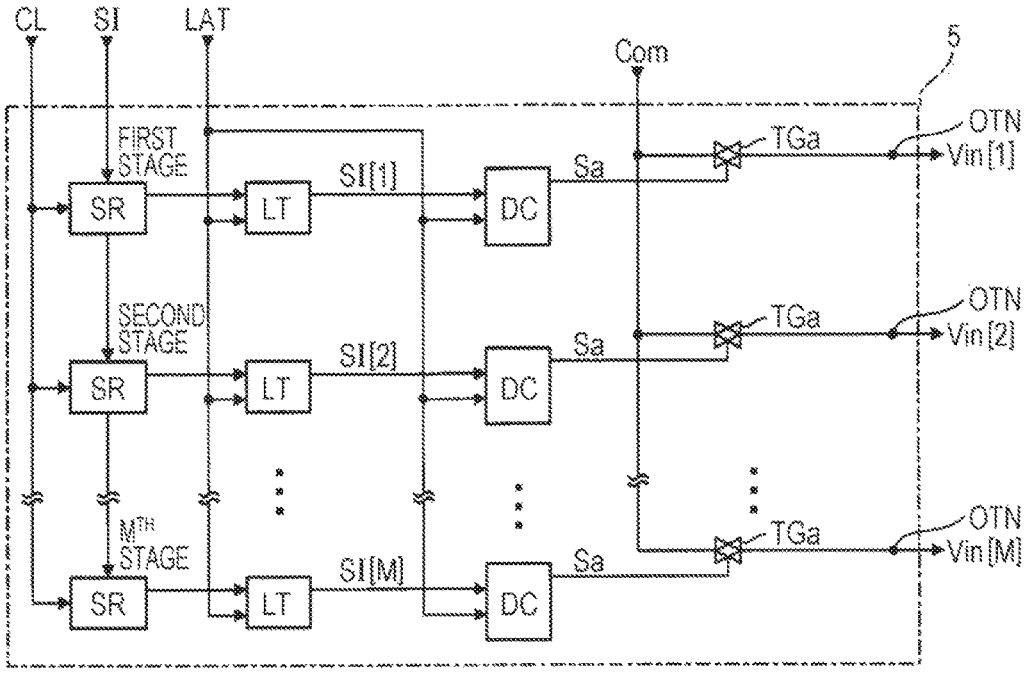
FIG. 6 is a block diagram illustrating a configuration of a drive signal generation unit.
FIG. 7 is an explanatory diagram illustrating a content of decoding by a decoder.

FIG. 6 is a block diagram illustrating the configuration of the drive signal generation unit 5. As illustrated in FIG. 6, the drive signal generation unit 5 includes M groups of shift registers SR, latch circuits LT, decoders DC, and transmission gates TGa and TGb so as to be one-to-one corresponding to M discharge units 35. Hereinafter, in some cases, each element that configures these M groups will be referred to as a first stage, a second stage, . . . , an Mth stage in this order.

A clock signal CL, a latch signal LAT, the print signal SI, and the drive waveform signal Com are supplied to the drive signal generation unit 5 from the control unit 6.

Here, the print signal SI is a 3 bit signal that regulates whether or not to discharge the ink from each discharge unit 35(each nozzle N), a size of the dot, and a strength of the micro-vibration at the time of non-discharge, for forming one dot of image. The print signal SI is serially supplied to the drive signal generation unit 5 from the control unit 6 in synchronization with the clock signal CL.

By controlling whether or not to discharge the ink from each discharge unit 35, the size of the dot, and the strength of the micro-vibration at the time of non-discharge using this print signal SI, it is possible to express each dot on the medium 22 in four steps such a large dot, a middle dot, a small dot, and the non-record.

Each shift register SR once holds the print signal SI for every 3 bits corresponding to each discharge unit 35. Specifically, the M shift registers SR that is one-to-one corresponding to M discharge units 35 are connected to each other in cascade, and the serially supplied print signal SI are sequentially transferred to the next stage according to the clock signal CL. Then, at a time point when the print signal SI are transferred to the entire M shift registers SR, the clock signal CL is stopped to be supplied, and each of the M shift registers SR maintains the state of holding the data of 3 bits corresponding to itself among the print signals SI.

Each of the M latch circuits LT simultaneously latches the print signal SI of 3 bits corresponding each stage held in each of the M shift registers S at the timing when the latch signal LAT rises. In FIG. 6, each of the SI[1], SI[2], . . . , SI[M] indicate the print signals SI of 3 bits latched by the latch circuit LT corresponding to each of the shift registers SR of the first stage, second stage, . . . Mth stage.

Incidentally, an operation period that is a period during which the ink jet printer 1 executes the print processing consists of a multiple unit periods Tu.

The control unit 6 supplies the print signals SI to the drive signal generation unit 5 for each unit period Tu, and controls the drive signal generation unit 5 such that the latch circuit LT latches the print signal SI[1], SI[2], . . . , SI[M] for each unit period Tu. That is, the control unit 6 controls the drive signal generation unit 5 such that the drive signal Vin is supplied to the M discharge units 35 for each unit period Tu.

The decoder DC performs decoding on the print signal SI of 3 bits latched by the latch circuit LT and outputs the selection signal Sa in each unit period Tu. In the configuration in the present embodiment, the selection signals Sa of 5 bits are output at a predetermined timing during the unit period Tu. A data value of the selection signal Sa represented as 5 bits is set according to the size of the dots formed on the recording medium P by the ink discharged from each discharge unit 35 and the strength of the micro-vibration at the time of non-record. The details thereof will be described below.

FIG. 7 is an explanatory diagram (a table) illustrating a content of decoding performed by the decoder DC. FIG. 7 illustrates a relationship between the content (b1, b2, and b3) indicated by the print signal SI[m] and the selection signal Sa at the predetermined timing corresponding to the stage m (m is a natural number satisfying $1 \leq m \leq M$).

In a case where the content (b1, b2, and b3) indicated by the print signal SI[m] is (1, 1, and 1), the decoder DC in the stage m outputs the selection signal Sa that can be switched to level H, level L, level H, level L, and level Hat the predetermined timing within the unit period Tu.

In a case where the content (b1, b2, and b3) indicated by the print signal SI[m] is (1, 1, and 0), the decoder DC in the stage m outputs the selection signal Sa that can be switched to level H, level L, level L, level L, and level H at the predetermined timing within the unit period Tu.

In a case where the content (b1, b2, and b3) indicated by the print signal SI[m] is (1, 0, and 1), the decoder DC in the stage m outputs the selection signal Sa that can be switched to level H, level L, level L, level L, and level L at the predetermined timing within the unit period Tu.

As illustrated in FIG. 7, in a case where the content (b1, b2, and b3) indicated by the print signal SI[m] is (0, 1, and 1), the decoder DC in the stage m outputs the selection signal Sa that can be switched to low level L, high level H, low level L, high level H, and low level L at the predetermined timing within the unit period Tu.

In a case where the content (b1, b2, and b3) indicated by the print signal SI[m] is (0, 1, and 0), the decoder DC in the stage m outputs the selection signal Sa that can be switched to low level L, low level L, low level L, high level H, and low level L at the predetermined timing within the unit period Tu.

In a case where the content (b1, b2, and b3) indicated by the print signal SI[m] is (0, 0, and 1), the decoder DC in the stage m outputs the selection signal Sa that can be switched to low level L, high level H, low level L, low level L, and low level L at the predetermined timing within the unit period Tu.

The description will be returned to FIG. 6.

As illustrated in FIG. 6, the drive signal generation unit 5 includes M transmission gates TGa. These M transmission gates TGa are provided so as to be one-to-one corresponding to the M discharge units 35. The transmission gate TGa becomes ON state when the selection signal Sa is in level H and becomes OFF when the selection signal Sa is in level L.

The drive waveform signal Com is supplied to one end of the transmission gate TGa. The other end of the transmission gate TGa is connected to an output terminal OTN to the discharge unit 35. Therefore, the drive waveform signal Com selected by the transmission gate TGa of stage m is output to the output terminal OTN of stage m during each unit period Tu as the drive signal Vin[m] with respect to the output terminal OTN of stage m. In addition, the drive signal Vin[m] is supplied to the piezoelectric element 74 in the discharge unit 35 of stage m.

Figure 8:
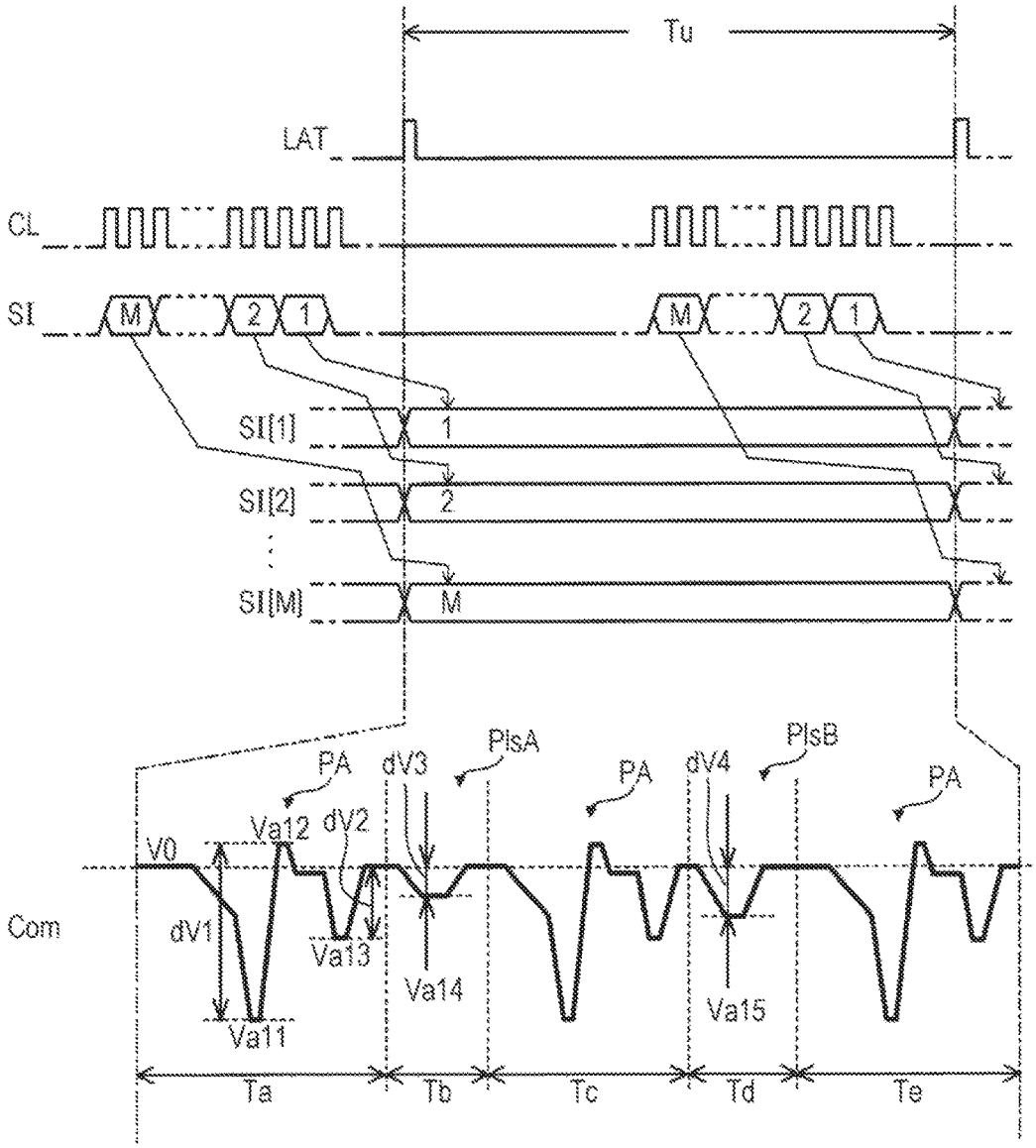
FIG. 8 is a timing chart illustrating an operation of the drive signal generation unit during a unit period.

FIG. 8 is an example of a timing chart for describing the operation of the drive signal generation unit 5 during each unit period Tu. As illustrated in FIG. 8, the unit period Tu is defined by a latch signal LAT output from the control unit 6. At the timing when the latch signal LAT rises, that is, at the timing when the unit period Tu starts, the print signals SI[1], SI[2], . . . , SI[M] are output from M latch circuits LT.

As illustrated in FIG. 8, the drive waveform signal Com supplied from the control unit 6 during the unit period Tu shows a waveform having a drive waveform PA, the micro-vibration waveform PlsA and the micro-vibration waveform PlsB. In a case where the drive waveform signal Com is supplied to the piezoelectric element 74 and the discharge unit 35 is driven by the drive waveform PA of the drive waveform signal Com, the drive waveform PA is determined to have a waveform such that a predetermined amount of ink is discharged from the nozzle N on the discharge unit 35. For example, in a case where the discharge unit 35 is driven by the drive waveform PA, an electric potential difference dV1 between an electric potential Va11 and an electric potential Va12 of the drive waveform PA is determined such that a predetermined amount of ink is discharged from the nozzle N included in the discharge unit 35.

In addition, in a case where the discharge unit 35 is driven by the drive waveform PA, an electric potential difference dV2 between an electric potential Va13 and the reference electric potential V0 of the driving waveform PA is determined such that a predetermined amount of ink is discharged from the nozzle N included in the discharge unit 35.

In the unit period Tu, the drive waveform PA is included in three periods such as periods Ta, Tc, and Te. Which drive waveform PA among those included in three periods will be used as the drive waveform for driving the discharge unit 35 is set according to the size of the dots.

In a case where the piezoelectric element 74 included in the discharge unit 35 is driven by the micro-vibration waveform, the micro-vibration waveform PlsA and the micro-vibration waveform PlsB is determined to be a waveform such that a predetermined amount of ink is not discharged from the nozzle N included in the discharge unit 35. The micro-vibration waveform PlsA has an electric potential difference dV3 between the electric potential Va14 and the reference electric potential V0, and the micro-vibration waveform PlsB has an electric potential difference dV4 between the electric potential Va15 and the reference electric potential V0.

In the unit period Tu, the micro-vibration waveform PlsA and the micro-vibration waveform PlsB are included in two periods such as periods Tb and Td. Which micro-vibration waveform among those included in two periods will be used as the micro-vibration waveform at the time of non-record is set according to the strength of the micro-vibration.

The strength of the micro-vibration is set according to viscosity characteristics of the ink in using. That is, which of the micro-vibration waveform PlsA or the micro-vibration waveform PlsB will be used, or whether or not both the micro-vibration waveform PlsA and the micro-vibration waveform PlsB will be used is set according to the viscosity characteristics.

In addition, even in a case the same ink, since the viscosity characteristics changes with the time, the selection pattern of the micro-vibration waveform for driving the discharge unit 35 is set corresponding to the change.

Both the electric potential at the start timing of the micro-vibration waveform PlsA and the micro-vibration waveform PlsB and the electric potential at the end timing of the micro-vibration waveform PlsA and the micro-vibration waveform PlsB are set to the reference electric potential V0.

Figure 5C:
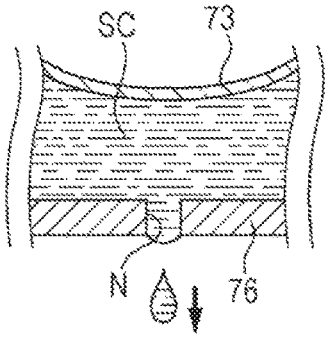
FIG. 5C is an explanatory diagram explaining a change of the sectional shape of the discharge unit when the drive signal is supplied.

As described using FIG. 5A to FIG. 5C, the pressure in the discharge unit 35(cavity SC) increases or decreases according to the voltage applied to the piezoelectric element 74. In other words, an amount of increases or decreases of the pressure in the discharge unit 35 depend on an amount of change of the voltage applied to the piezoelectric element 74. Therefore, a discharge speed of the ink discharged from the discharge unit 35, an amount of discharge of the ink, and the like are determined bases on the electric potential difference dV (dV1, dV2). In addition, the discharge speed of the ink discharged from the discharge unit 35 and the amount of discharge also depend on the period in which the drive waveform PA is used in the unit period Tu. In the present embodiment, the periods are set as three periods such as periods Ta, Tc, and Te in a case of large dots, two periods such as periods Ta and Te in a case of middle dots, and one period such as a period Ta in a case of small dots as illustrated in FIG. 8.

In the discharge unit 35 from which the ink is not discharged, since the ink is thickened due to dryness in the vicinity of the nozzles N, the micro-vibration waveforms PlsA and PlsB which are such waveforms that the ink is not discharged from the nozzles N causes the piezoelectric element 74 to vibrate as the micro-vibration. The strength of the micro-vibration depends on the electric potential difference dV (dV3, dV4). The strength of the micro-vibration also depends on the shape of the micro-vibration waveforms PlsA and PlsB other than the electric potential difference dV(dV3, dV4). That is, it depends on the shape of the waveform (for example, the shape of the waveform indicating whether or not the change of the waveform is a straight line, the slope of the change, or the like) when the electric potential is changed from the electric potential Va14 or Va15 to the electric potential V0.

Furthermore, the strength of the micro-vibration also depends on the number of times the micro-vibration waveforms PlsA and PlsB are used during the unit period Tu. In the present embodiment, in a case where a degree of thickening is large, the micro-vibration waveform PlsA is used during the period Tb and the micro-vibration waveform PlsB is used during the period Td illustrated in FIG. 8. In a case where the degree of thickening is middle, the micro-vibration waveform PlsB is used during the period Td. In a case where the degree of thickening is small, the micro-vibration waveform PlsA is used during the period Tb.

Since the degree of thickening depends on the type of the ink, in the present embodiment, the pattern of selecting the appropriate micro-vibration waveform for each ink is set in advance by an experiment or the like using a standard type ink. Here, the standard type ink means, for example, a genuine ink managed and manufactured by a manufacturer of a printer, and the manufacture grasps the characteristics of the ink. As a result, the appropriate micro-vibration waveform is known.

Next, the drive signal Vin generated based on the drive waveform signal Com described above will be described. FIG. 9 to FIG. 14 are timing charts indicating the relationships between the selection signal Sa, the drive waveform signal Com, and the drive signal Vin during one unit period Tu.

Figure 9:
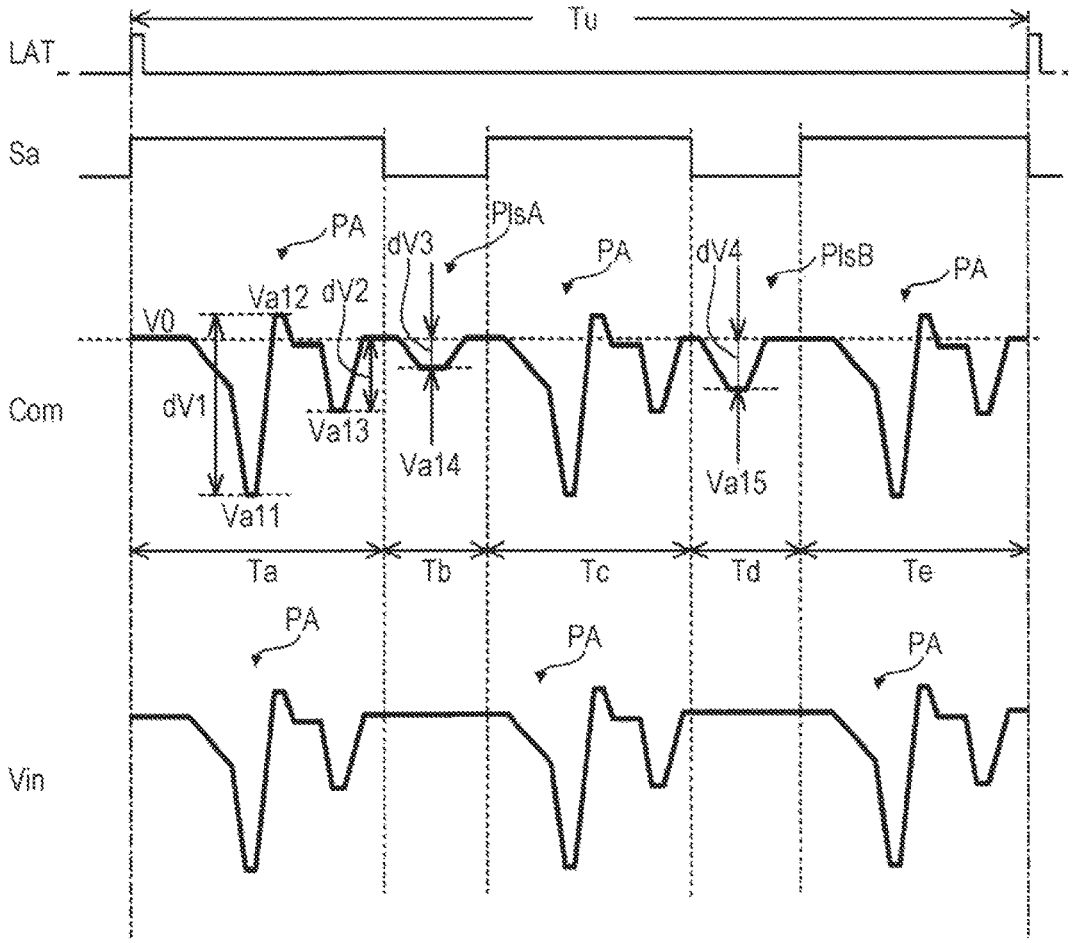
FIG. 9 is a timing chart illustrating a relationship between a selection signal and the drive signal in a case of large dots.

FIG. 9 illustrates the selection signal Sa and the drive signal Vin in a case of the "large dots" illustrated in FIG. 7. As illustrated in FIG. 9, the selection signal Sa in a case of "large dots" becomes level H during the period Ta, becomes level L during the period Tb, becomes level H during the period Tc, becomes level L during the period Td, and becomes level H during the period Te. The transmission gate TGa illustrated in FIG. 6 is in ON state when the selection signal Sa is in level H, and is in OFF state when the selection signal Sa is in level L. Therefore, the drive signal Vin has a waveform that includes the drive waveform PA during the periods Ta, Tc, and Te.

Figure 10:
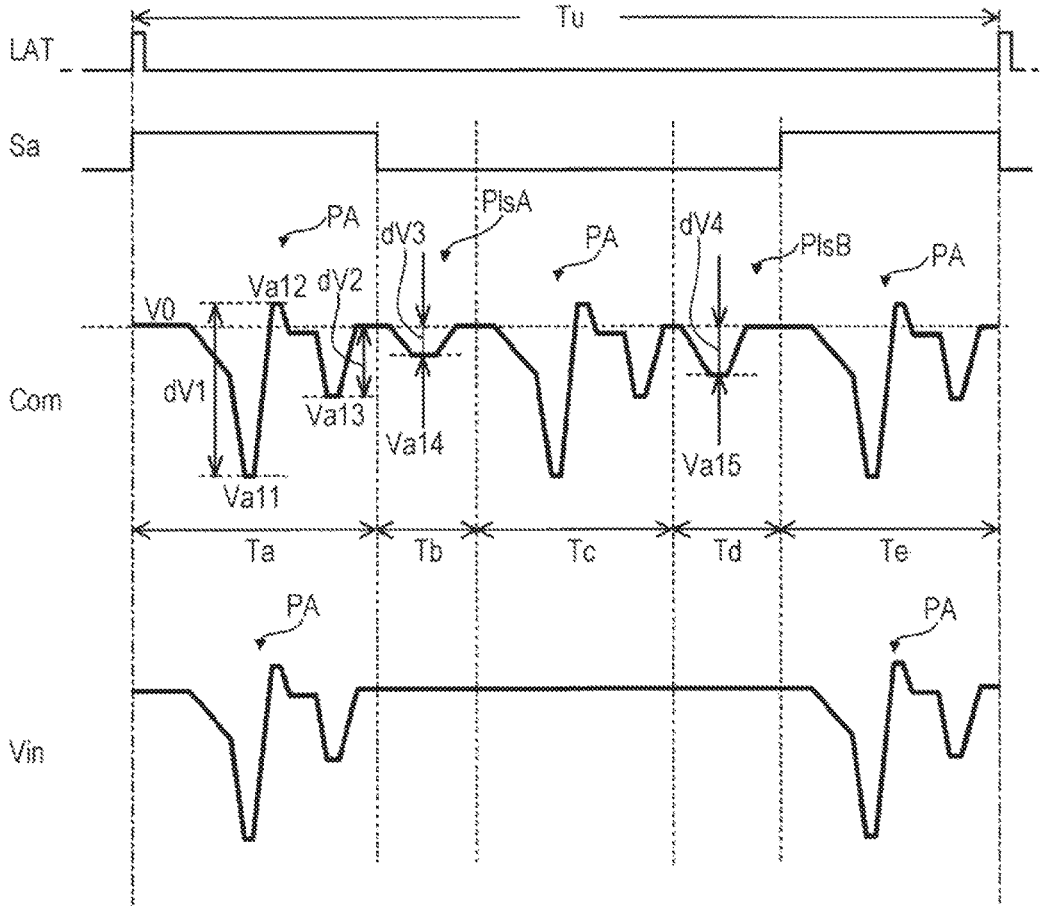
FIG. 10 is a timing chart illustrating a relationship between the selection signal and the drive signal in a case of middle dots.

FIG. 10 illustrates the selection signal Sa and the drive signal Vin in a case of the "middle dots" illustrated in FIG. 7. As illustrated in FIG. 10, the selection signal Sa in a case of "middle dots" becomes level H during the period Ta, becomes level L during the period Tb, becomes level L during the period Tc, becomes level L during the period Td, and becomes level H during the period Te. Therefore, the drive signal Vin has a waveform that includes the drive waveform PA during the periods Ta and Te.

Figure 11:
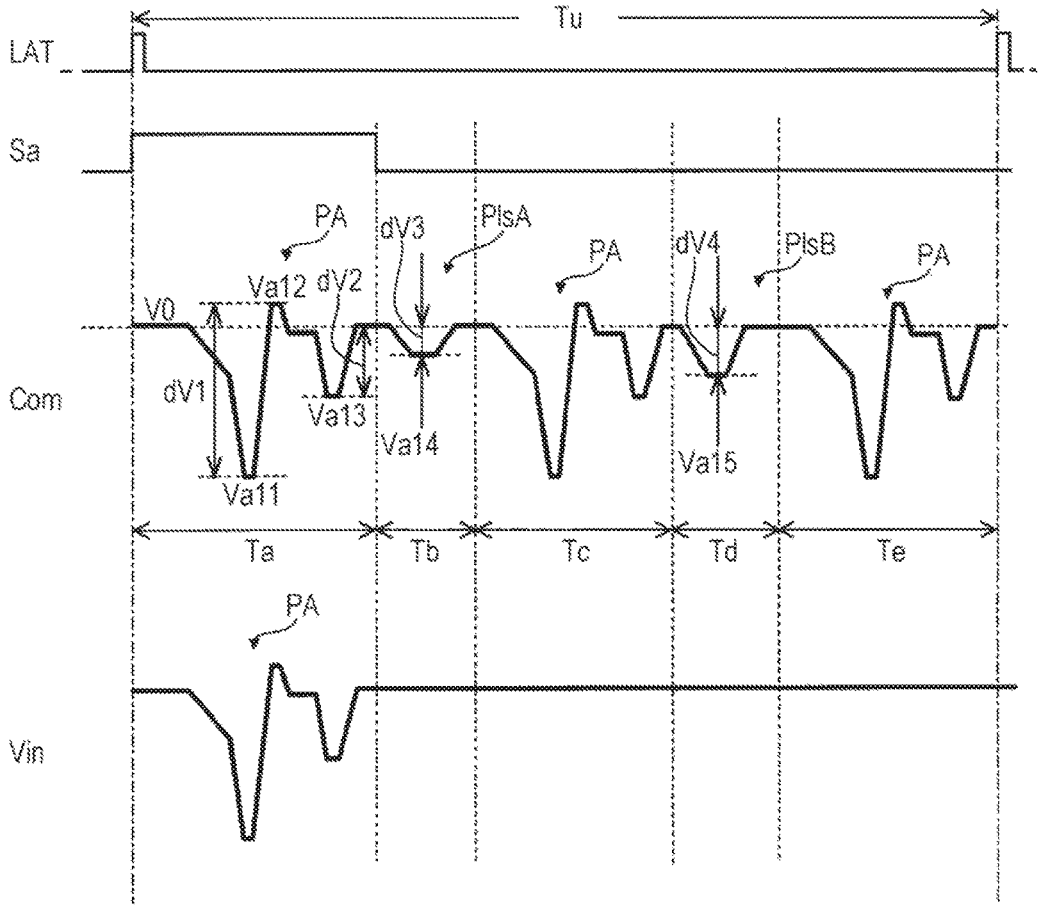
FIG. 11 is a timing chart illustrating a relationship between the selection signal and the drive signal in a case of small dots.

FIG. 11 illustrates the selection signal Sa and the drive signal Vin in a case of the "small dots" illustrated in FIG. 7. As illustrated in FIG. 11, the selection signal Sa in a case of "middle dots" becomes level H during the period Ta, becomes level L during the period Tb, becomes level L during the period Tc, becomes level L during the period Td, and becomes level L during the period Te. Therefore, the drive signal Vin has a waveform that includes the drive waveform PA during the periods Ta.

Figure 12:
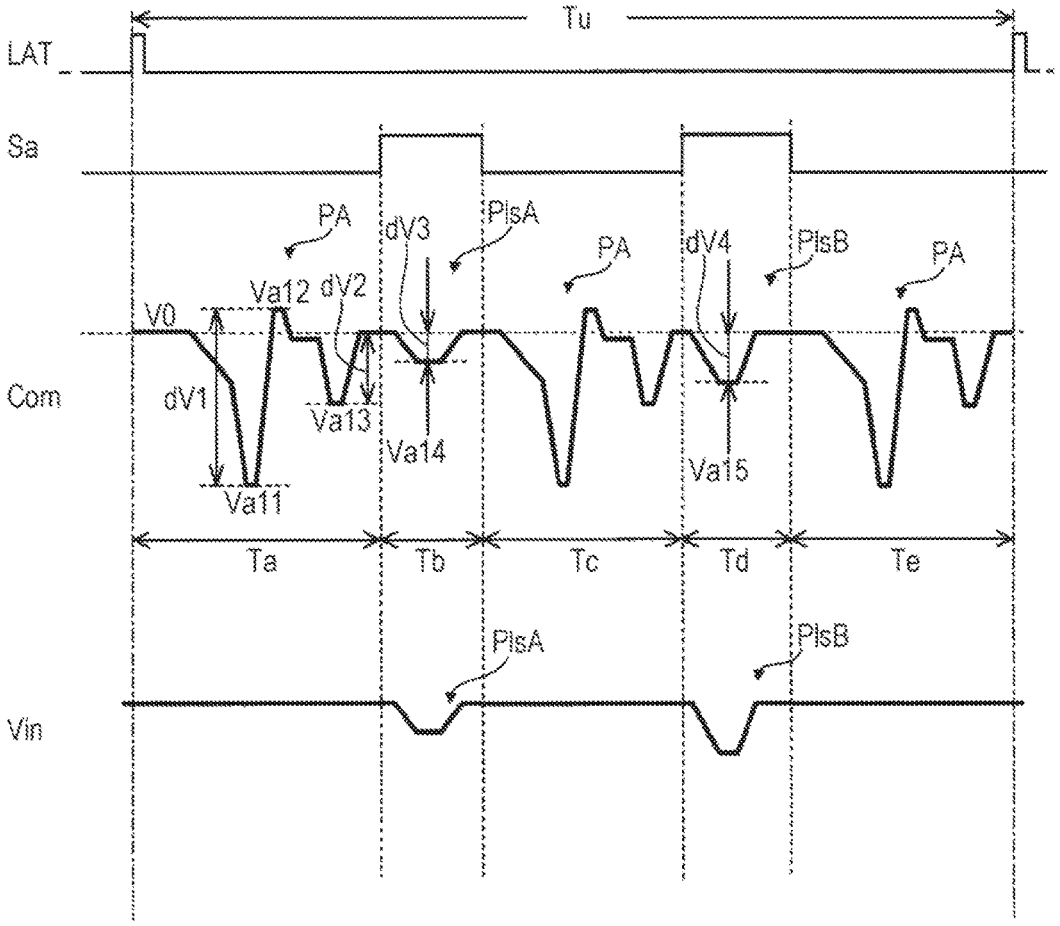
FIG. 12 is a timing chart illustrating a relationship between the selection signal and the drive signal in a case of non-record.

FIG. 12 illustrates the selection signal Sa and the drive signal Vin in a case of the "non-record 1" illustrated in FIG. 7. As illustrated in FIG. 12, the selection signal Sa in a case of "non-record 1" becomes level L during the period Ta, becomes level H during the period Tb, becomes level L during the period Tc, becomes level H during the period Td, and becomes level L during the period Te. Therefore, the drive signal Vin has a waveform that includes the micro-vibration waveform PlsA during the periods Tb and the micro-vibration waveform PlsB during the period Td. In the present embodiment, the micro-vibration becomes strongest in a case of the "non-record 1".

Figure 13:
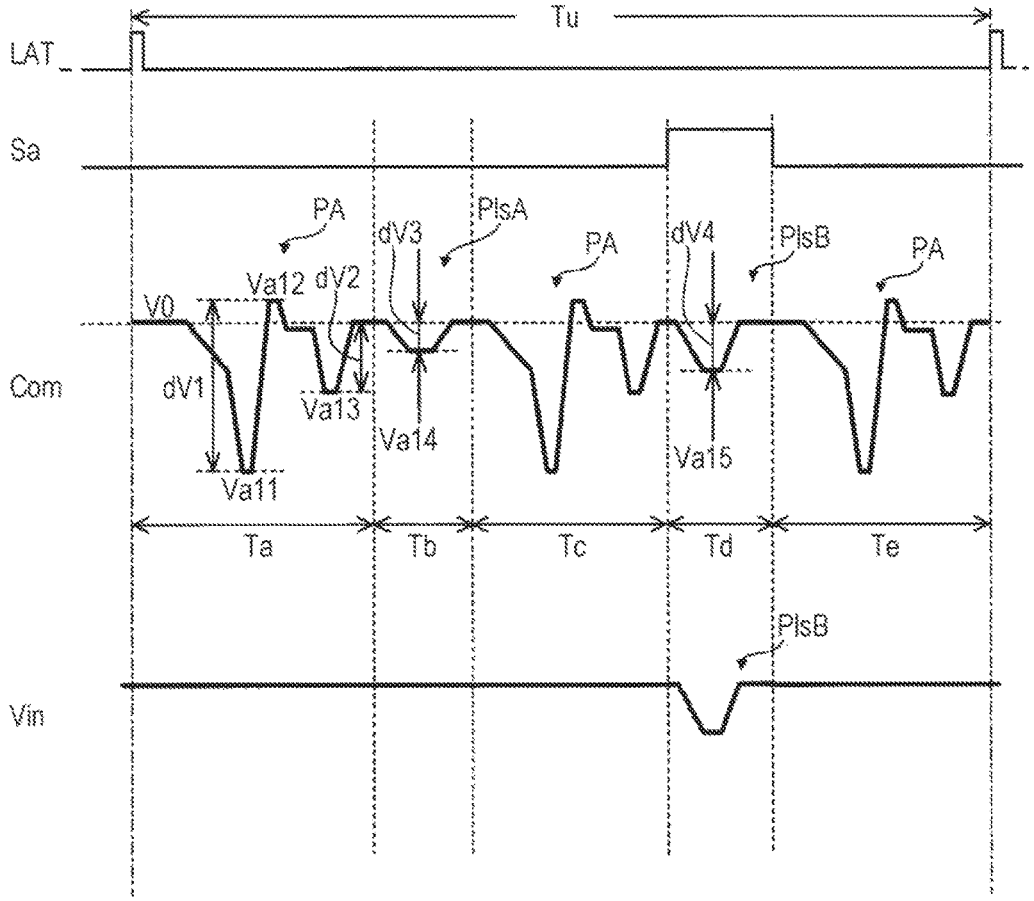
FIG. 13 is a timing chart illustrating a relationship between the selection signal and the drive signal in a case of non-record.

FIG. 13 illustrates the selection signal Sa and the drive signal Vin in a case of the "non-record 2" illustrated in FIG. 7. As illustrated in FIG. 13, the selection signal Sa in a case of "non-record 2" becomes level L during the period Ta, becomes level L during the period Tb, becomes level L during the period Tc, becomes level H during the period Td, and becomes level L during the period Te. Therefore, the drive signal Vin has a waveform that includes the micro-vibration waveform PlsB during the period Td. In the present embodiment, the strength of the micro-vibration is middle level in a case of the "non-record 2".

Figure 14:
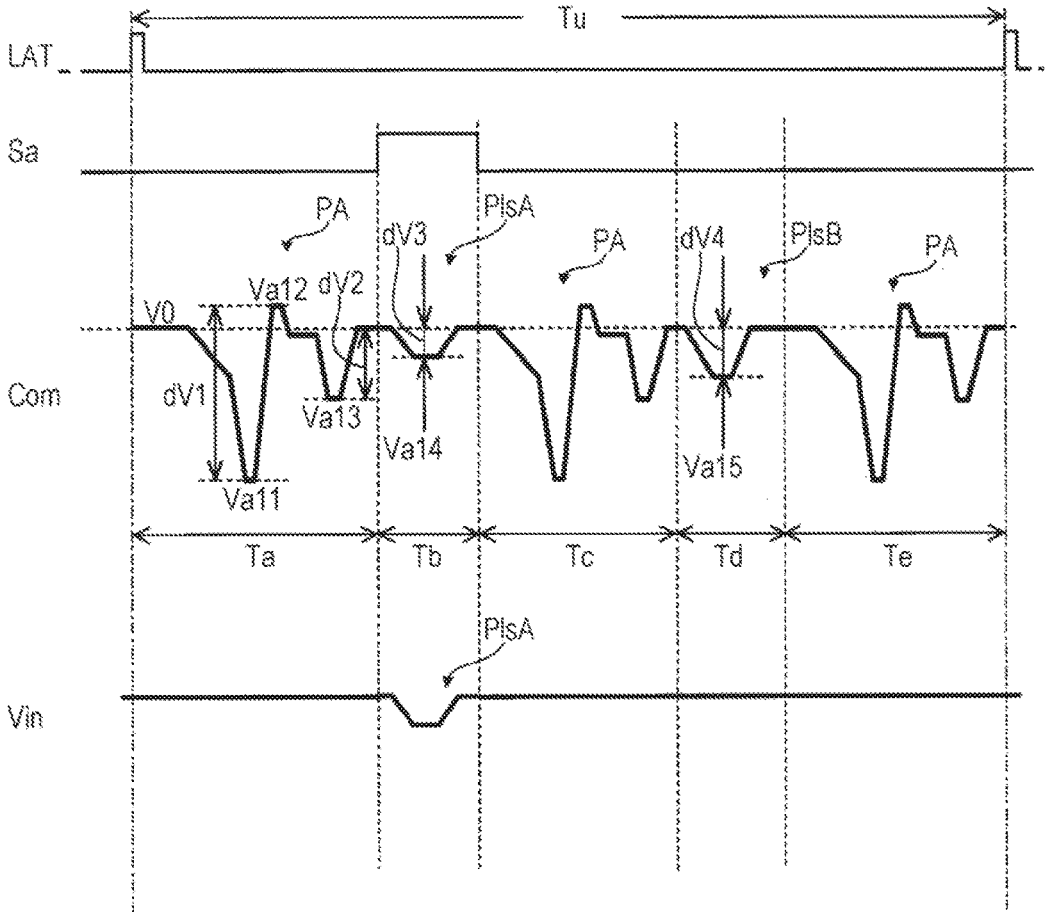
FIG. 14 is a timing chart illustrating a relationship between the selection signal and the drive signal in a case of non-record.

FIG. 14 illustrates the selection signal Sa and the drive signal Vin in a case of the "non-record 3" illustrated in FIG. 7. As illustrated in FIG. 14, the selection signal Sa in a case of "non-record 3" becomes level L during the period Ta, becomes level H during the period Tb, becomes level L during the period Tc, becomes level L during the period Td, and becomes level L during the period Te. Therefore, the drive signal Vin has a waveform that includes the micro-vibration waveform PlsA during the period Tb. In the present embodiment, the micro-vibration becomes weakest in a case of the "non-record 3".

Figure 15:
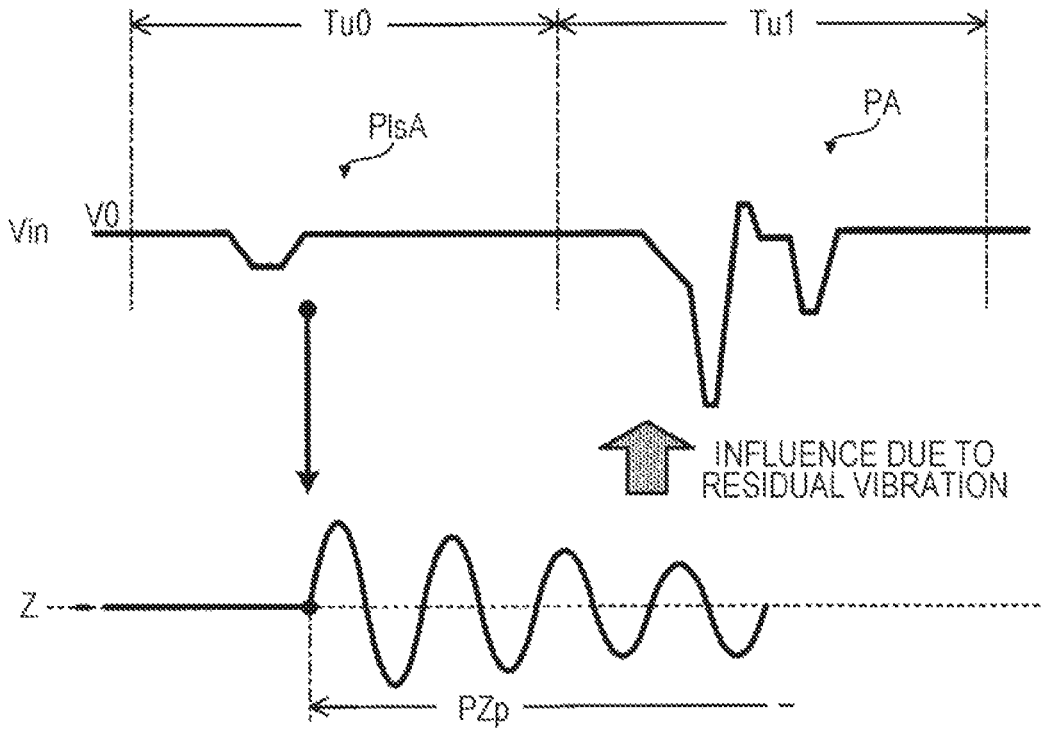
FIG. 15 is an explanatory diagram for explaining a residual vibration generated by a micro-vibration waveform being supplied to the discharge unit.

Next, the residual vibration in a case where the micro-vibration waveform PlsA or the micro-vibration waveform PlsB is used as the drive signal Vin will be described. FIG. 15 is an explanatory diagram for explaining an influence caused by the residual vibration Z to the driving of the discharge unit 35 during the subsequent another unit period Tu in a case where the micro-vibration waveform PlsA is supplied to the discharge unit 35 as the drive signal Vin during one unit period Tu.

As illustrated in FIG. 15, when the drive signal Vin including the micro-vibration waveform PlsA is supplied to the discharge unit 35, the residual vibration Z occurs in the discharge unit 35 (hereinafter, a waveform of the residual vibration Z will be referred to as a waveform PZp). In this case, an amount of increases or decreases of the pressure in the discharge unit 35 occurring during the unit period Tu1 is determined based on the shape of the drive waveform PA of the drive signal Vin supplied during the unit period Tu1 and the shape of the waveform PZp of the residual vibration Z occurring during the unit period Tu0. In this case, if the micro-vibration due to the micro-vibration waveform PlsA is too strong, the amount of discharge of the ink increases due to the increase of the pressure in the discharge unit 35 due to the residual vibration Z, and thus, the dots of appropriate size cannot be obtained. In addition, if the micro-vibration due to the micro-vibration waveform PlsA is too weak, the thickening of the ink in the vicinity of the nozzles N is not eliminated, for example, the ink is not discharged, and thus, the missing dots may occur. This phenomenon similarly occurs in a case where the drive waveform PA is supplied to the discharge unit 35 as the drive signal Vin during another subsequent unit period Tu after micro-vibration waveform PlsB is supplied to the discharge unit 35 as the drive signal Vin during one unit period Tu.

Therefore, in the present embodiment, the micro-vibration waveform PlsA and the micro-vibration waveform PlsB are determined to be the waveforms such that the ink is not discharged from the nozzles N included in the discharge unit 35 and determined to be the waveforms such that the above-described influence does not occur due to the residual vibration Z. Since the degree of thickening and the degree of the influence due to the residual vibration Z depend on the type of the ink, in the present embodiment, the micro-vibration waveform appropriate to each ink is set in advance by the experiment or the like using the standard type ink.

Next, an adjustment mode for adjusting the strength of the micro-vibration caused by the micro-vibration waveform in the present embodiment will be described. As described above, in the present embodiment, the micro-vibration waveform appropriate for each ink is set based on the standard type ink. However, in an actual usage mode, in some cases, an ink other than the standard type ink is used depending on the need of the user. For example, in some cases, a fluorescent color ink that is not included in the standard type ink is used.

When such ink other than the standard type ink is used, in some cases, the micro-vibration waveform is not appropriate to the ink, and thus, it can be considered that the excess or shortage in the amount of discharge of the ink may occur due to the above-described residual vibration Z. Therefore, in the present embodiment, the adjustment mode for adjusting the strength of the micro-vibration caused by the micro-vibration waveform is provided as one of the operation modes.

Figure 23:
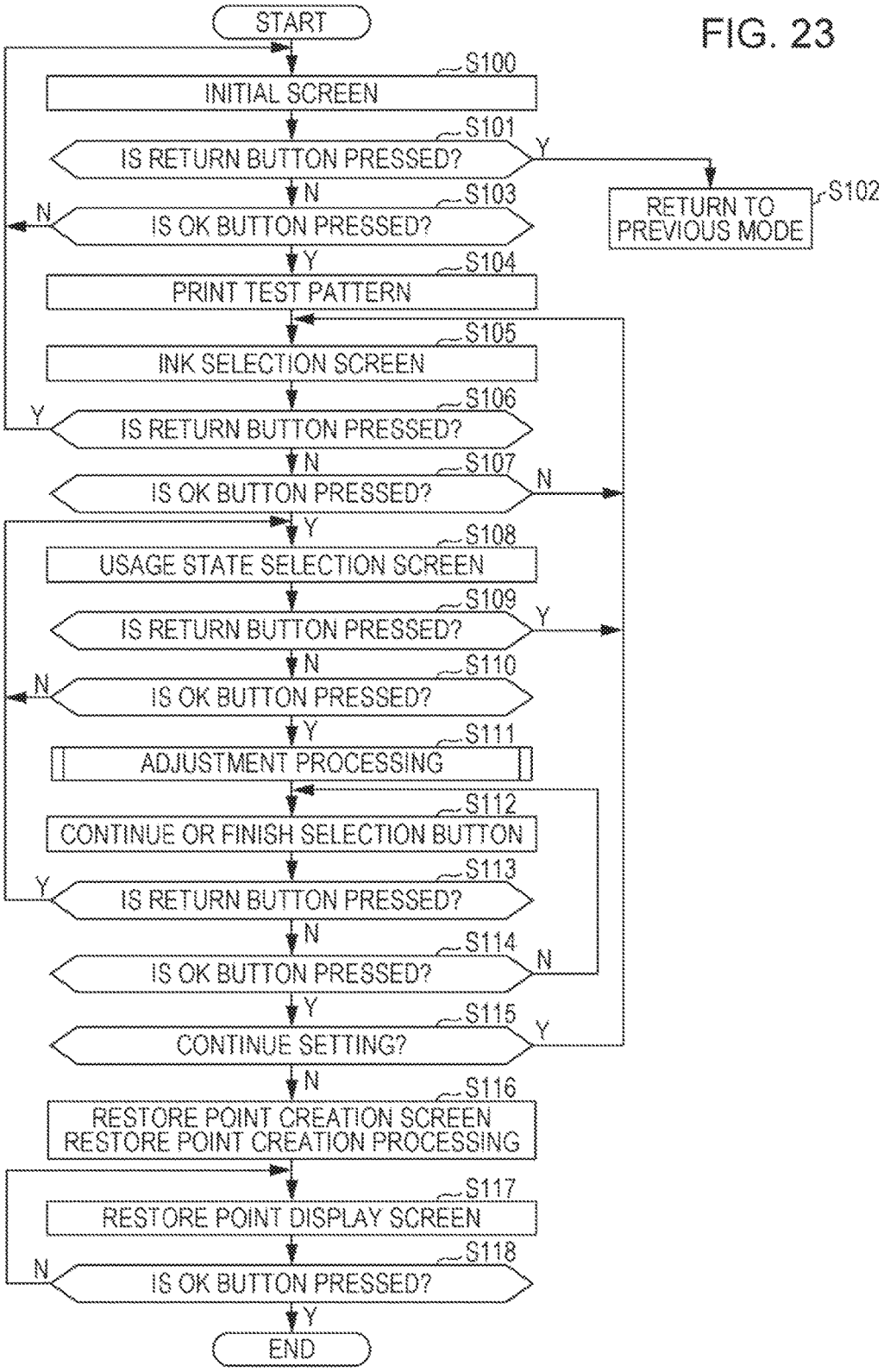
FIG. 23 is a flowchart of the adjustment mode for adjusting a strength of a micro-vibration caused by the micro-vibration waveform.
Figure 24:
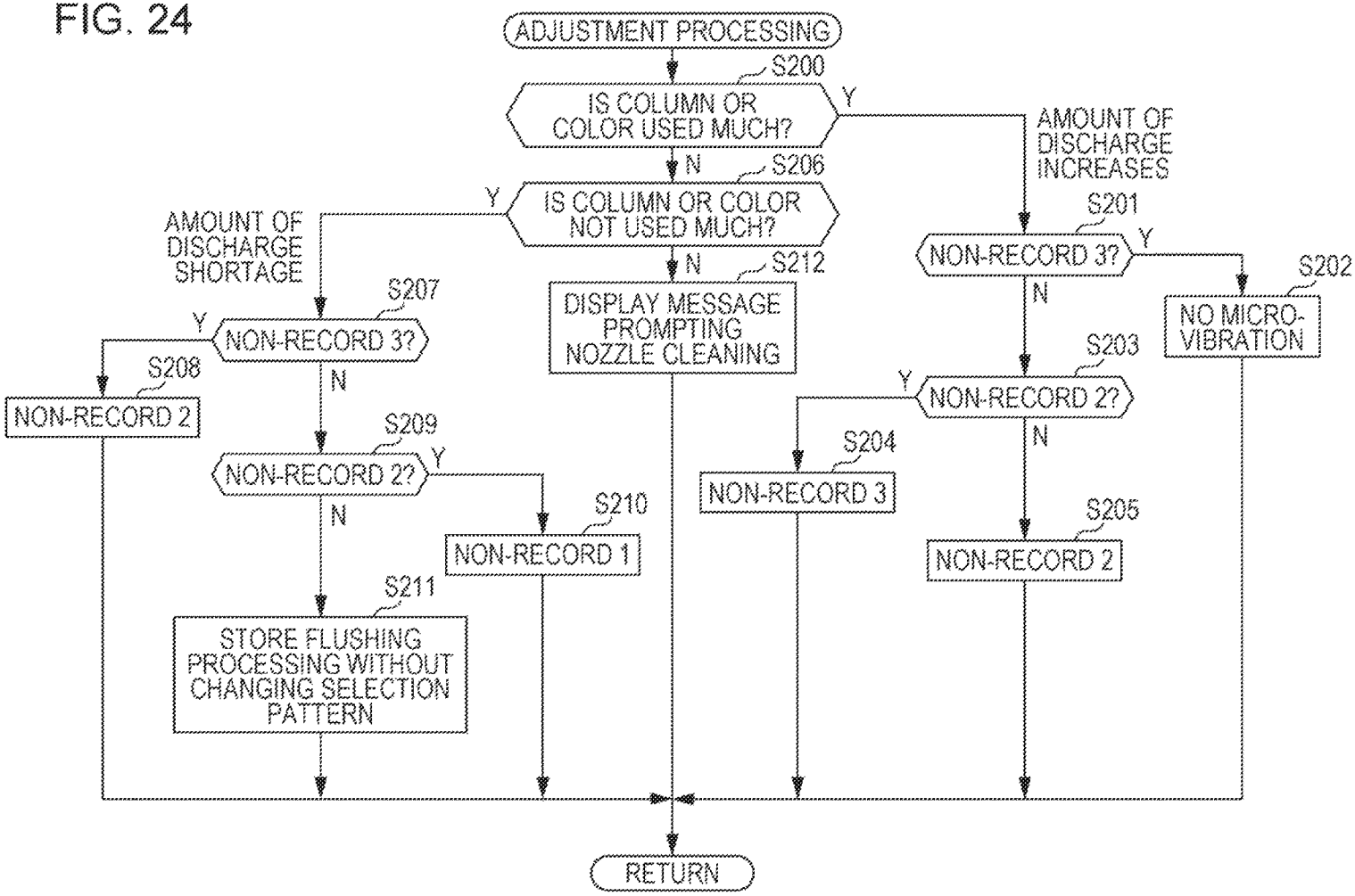
FIG. 24 is a flowchart of adjustment processing that adjusts the strength of the micro-vibration caused by the micro-vibration waveform.

FIG. 16 to FIG. 21 are diagrams illustrating examples of information display on the presentation unit 41 in the adjustment mode for adjusting the strength of the micro-vibration caused by the micro-vibration waveform. FIG. 22 is a diagram for describing an order of changing the selection pattern of the micro-vibration waveform in the present embodiment. FIG. 23 is a flowchart of the adjustment mode for adjusting the strength of the micro-vibration caused by the micro-vibration waveform in the present embodiment. FIG. 24 is a flowchart of the processing for adjusting the strength of the micro-vibration caused by the micro-vibration waveform in the present embodiment. In the description below, signs S100 to S118 indicate processing step numbers illustrated in FIG. 23. In addition, signs S200 to S211 indicate processing step numbers illustrated in FIG. 24.

Figure 16:
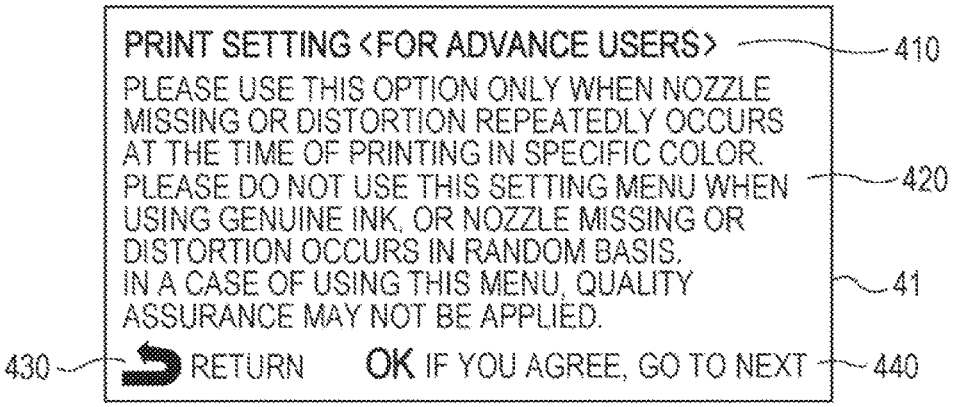
FIG. 16 is an example of an initial screen in an adjustment mode.

In the present embodiment, the user can switch the operation mode to the adjustment mode by operating the operation unit 42 on the operation panel 4. When the adjustment mode is selected, the control unit 6 causes the presentation unit 41 to display an initial screen of the adjustment mode (S100). FIG. 16 illustrates an example of the initial screen of the adjustment mode.

As illustrated in FIG. 16, in the initial screen, the control unit 6 causes the title portion 410 of the presentation unit 41 to display "print setting <for advanced user>" to indicate that the operation mode is switched to the adjustment mode. The control unit 6 causes the message portion 420 of the presentation unit 41 to display "precautions". The control unit 6 causes a return button 430 and an OK button 440 to be displayed on the lower part of the presentation unit 41. When it is determined that the return button 430 is pressed (Y in S101), the control unit 6 returns the operation mode to the mode before switching to the adjustment mode (S102). When it is determined that the OK button 440 is pressed (Y in S103), the control unit 6 performs processing for printing a test pattern (S104). In addition, the control unit 6 switches the display on the presentation unit 41 to the ink selection screen illustrated in FIG. 17 (S105).

Figure 17:
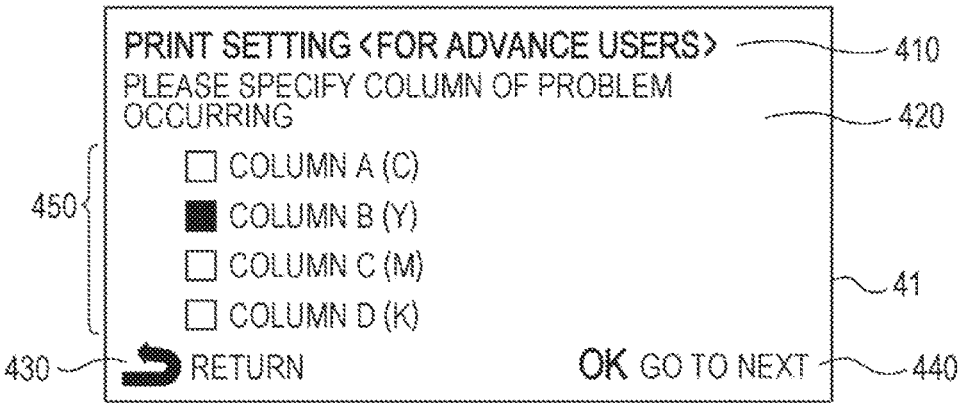
FIG. 17 is an example of an ink selection screen in the adjustment mode.

FIG. 17 is an example of the ink selection screen in the adjustment mode. As illustrated in FIG. 17, on the ink selection screen, an ink selection button 450 is displayed together with a message saying "Please specify the problematic column" on the message portion 420. The ink selection button 450 includes buttons that respectively select a column A corresponding to cyan (C), a column B corresponding to yellow (Y), a column C corresponding to magenta (M), and a column D corresponding to black (K). Each of the column A, column B, column C, and column D correspond to the nozzle columns illustrated in FIG. 3. In the present embodiment, the type of ink selected on the ink selection screen is used as indirect information from which a situation of ink discharge can be estimated. As described above, the presentation unit 41 presents the screen so as to select the indirect information from which a situation of ink discharge can be estimated.

The user determines whether or not there occurs a problem in that the density or line width of the image becomes unstable when a specific color is continuously printed, based on the printed test pattern. In addition, the user determines whether or not there occurs a problem in that the image for a specific color is missed when an intermittent printing in which the printing is performed after a plurality of space lines is performed, based on the test pattern. In the present embodiment, it assumed that a pattern of the continuous printing and a pattern of the intermittent printing are included in the test pattern.

In a case where the user determines that there is no problems described above, the display on the presentation unit 41 is returned to the display illustrated in FIG. 16 by pressing the return button 430, and the adjustment mode can ended by further pressing the return button 430. When it is determined that the return button 430 is pressed (Y in S106), the control unit 6 returns the display on the presentation unit 41 to the display of the initial screen illustrated in FIG. 16 (S100). The processing when the return button 430 on the initial screen is pressed is as described above.

On the other hand, in a case where the user determines that there is are problems described above, the color of the ink in which the problem occurs can be selected using the ink selection button 450. In the example in FIG. 17, an example selecting the column B corresponding to yellow is illustrated. When it is determined that the ink selection button 450 is pressed and further the OK button 440 is pressed (Y in S107), the control unit 6 switches the display on the presentation unit 41 to the display illustrated in FIG. 18 (S108).

Figure 18:
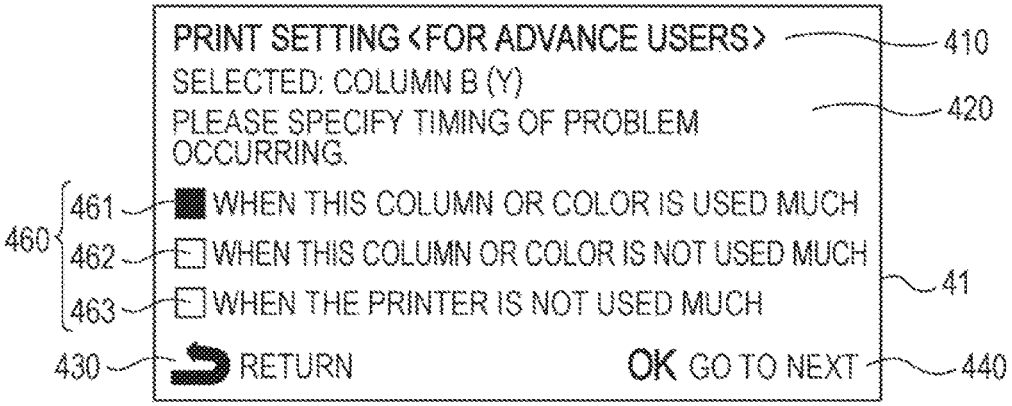
FIG. 18 is an example of a screen for selecting a usage state.

FIG. 18 is an example of a screen for selecting the usage state of the ink or the printer when such a problem occurs. The selected ink and a message saying "please specify the timing of problem occurring" are displayed on the message portion 420. A usage state selection button 460 is displayed below this message. The usage state selection button 460 includes a first button 461 for selecting a message "when this column or color is used much", a second button 462 for selecting a message "when this column or color is not used much", and a third button 463 for selecting a message "when the printer is not used much".

In a case where it is determined that the problem occurs in the pattern in which the ink of a specific color is used much, the user can press the first button 461. In this case, it is considered that the problem occurs in the situation in which the amount of discharge of the ink is large. In addition, in a case where it is determined that the problem occurs in a pattern in which the ink of a specific color is not used much, the user can press the second button 462. In this case, it is considered that the problem occurs in a situation in which the amount of discharge of the ink is small. As above, information that can be obtained by pressing the first button 461 or the second button 462 is used as information for estimating the of an amount degree of discharge of the ink.

In a case where it is determined that the problem occurs in a situation in which the printer is not used for a predetermined period, the user can press the third button 463. In this case, it is considered that the ink has not been used over the predetermined period, and thus, the problem occurs in a situation in which the frequency of using the ink is decreased. As above, information that can be obtained by pressing the third button 463 is used as information relating to the frequency of using the ink in the predetermined period.

As described above, in the present embodiment, the information that can estimate the amount degree of discharge of the ink or the information relating to the frequency of using the ink in the predetermined period can be obtained by selecting any one of the usage state selection button 460 illustrated in FIG. 18. In the present embodiment, any of the information that can estimate the amount degree of discharge of the ink or the information relating to the frequency of using the ink in the predetermined period can be obtained are used as one of the indirect information items that can estimate the ink discharge status. The presentation unit 41 presents the display such that the indirect information can be selected so as to estimate the ink discharge status.

In the example illustrated in FIG. 18, an example of pressing the button for selecting the message saying "when this column or color is used much" is illustrated. In this stage, when it is determined that the return button 430 is pressed (Y in S109), the control unit 6 returns the display on the presentation unit 41 to the ink selection screen illustrated in FIG. 17.

In a case where it is determined that any one button of the usage state selection button 460 is pressed and the OK button 440 is pressed (Y in S110), the control unit 6 executes the micro-vibration adjustment processing (S111). When it is determined that the button for selecting the message saying "when this column or color is used much" is selected (Y in S200), the control unit 6 executes the adjustment processing corresponding to the increase of the amount of discharge. In a situation in which the ink of a specific color is used much, it is considered that the period during which the drive signal Vin including the drive waveform PA is supplied to the discharge unit 35 is long and the period during which the drive signal Vin including the micro-vibration waveform supplied is short. Therefore, in this situation, the ink is frequently discharged from the discharge unit 35 and thus, it is predicted that the thickening of the ink of the color selected in FIG. 17 (hereinafter, referred to as the selected ink) is suppressed to be low. The problem occurring in this situation is considered to be a problem occurring because the pressure in the discharge unit 35 unstably increases due to the residual vibration of the micro-vibration waveform, and thus, the amount of discharge of the selected ink increases. Therefore, the control unit 6 changes the selection pattern of the micro-vibration waveform of the selected ink and weakens the strength of the micro-vibration.

FIG. 22 is a diagram for explaining an order of changing the selection pattern of the micro-vibration waveform in the present embodiment. As described above, in a case where the problem occurred is caused by the increase of the amount of discharge, the selection pattern of the micro-vibration waveform is changed such that the strength of the micro-vibration becomes lower by one step. The control unit 6 stores the changed selection pattern in the storage unit 62. In a case where it is determined that the current selection pattern with respect to the selected ink is "non-record 3" (Y in s201), the control unit 6 makes the selection pattern not to supply the micro-vibration waveform to the discharge unit 35 of the selected ink (S202). The "non-record 3" is a case where the strength of the micro-vibration is the weakest as illustrated in FIG. 7 and FIG. 14. Even in this case, in order to weaken the strength of the micro-vibration, the control unit 6 changes the selection pattern to the selection pattern not to supply the micro-vibration waveform to the discharge unit 35 of the selected ink. This selection pattern is not illustrated in FIG. 7, however, a selection pattern that outputs the selection signal Sa of which level is level L through the entire period during one unit of period Tu may be newly provided. For example, in the configuration may be provided such that, when the data value of the print signal SI is (0, 0, 0), the selection signal Sa of which the level during the entire period may be the level L is output.

In a case where it is determined that the current selection pattern with respect to the selected ink is "non-record 2" (N in S201 and Y in s203), the control unit 6 changes the selection pattern to "non-record 3" (S204). The "non-record 2" is a case where the strength of the micro-vibration is middle as illustrated in FIG. 7 and FIG. 13. Even in this case, in order to weaken the strength of the micro-vibration in the discharge unit 35 of the selected ink by one step, the control unit 6 changes the selection pattern to the "non-record 3" in which the strength of the micro-vibration is the weakest. The control unit 6 stores the changed selection pattern in the storage unit 62.

In a case where it is determined that the current selection pattern with respect to the selected ink is "non-record 1" (N in S203), the control unit 6 changes the selection pattern to "non-record 2" (S205). The "non-record 1" is a case where the strength of the micro-vibration is the strongest as illustrated in FIG. 7 and FIG. 12. In this case, in order to weaken the strength of the micro-vibration in the discharge unit 35 of the selected ink by one step, the control unit 6 changes the selection pattern to the "non-record 2" in which the strength of the micro-vibration is middle. The control unit 6 stores the changed selection pattern in the storage unit 62.

As described above, in a case where it is determined that the first button 461 for selecting the message saying "when this column or color is used much" is pressed, the control unit 6 changes the selection pattern in the direction to weaken the micro-vibration. As a result, the amount of discharge of the ink decreases, and thus, it is expected that the problem described above can be eliminated.

When it is determined that the second button 462 for selecting the message illustrated in FIG. 18 saying "when this column or color is not used much" is selected (N in S200 and Y in S206), the control unit 6 executes the adjustment processing corresponding to the decrease of the amount of discharge. In a situation in which the ink of a specific color is not used much, it is considered that the period during which the drive signal Vin including the drive waveform PA is supplied to the discharge unit 35 is short and the frequency of discharging the ink from the discharge unit 35 decreases. That is, it is predicted that the thickening of the selected ink occurs. The problem occurring in this situation is considered to be a problem occurring because the thickening is not eliminated even by the micro-vibration waveform and the amount of discharge of the selected ink decreases. Therefore, the control unit 6 changes the selection pattern of the micro-vibration waveform of the selected ink and strengthens the strength of the micro-vibration.

As illustrated in FIG. 22, in a case where the problem occurred is caused by the decrease of the amount of discharge, the selection pattern of the micro-vibration waveform is changed such that the strength of the micro-vibration becomes higher by one step. The control unit 6 stores the changed selection pattern in the storage unit 62. In a case where it is determined that the current selection pattern with respect to the selected ink is "non-record 3" (Y in s207), the control unit 6 changes the selection pattern to "non-record 2" (S208). The "non-record 3" is a case where the strength of the micro-vibration is the weakest. In this case, in order to strengthen the strength of the micro-vibration in the discharge unit 35 of the selected ink by one step, the control unit 6 changes the selection pattern to the "non-record 2" in which the strength of the micro-vibration is middle. The control unit 6 stores the changed selection pattern in the storage unit 62.

In a case where it is determined that the current selection pattern with respect to the selected ink is "non-record 2" (N in S207 and Y in S209), the control unit 6 changes the selection pattern to "non-record 1" (S210). The "non-record 2" is a case where the strength of the micro-vibration is middle. In this case, in order to strengthen the strength of the micro-vibration in the discharge unit 35 of the selected ink by one step, the control unit 6 changes the selection pattern to the "non-record 1". The control unit 6 stores the changed selection pattern in the storage unit 62.

In a case where it is determined that the current selection pattern is "non-record 1" (N in S209), the control unit 6 stores the increase of the number of flushes in the storage unit 62, for example, when flushing processing is executed after ending the adjustment mode without changing the selection pattern (S211). The "non-record 1" is a case where the strength of the micro-vibration is the strongest. Therefore, since it is not possible to strengthen the strength of the micro-vibration equal to or stronger than this, the control unit 6 increases, for example, the number of flushes without changing the selection pattern. The flushing means the processing of supplying the drive signal Vin illustrated in FIG. 9 to the discharge unit 35 in a plurality of times and forcibly discharges the ink when the carriage 342 returns to a home position from the print range. By performing the flushing, drying of the ink in the vicinity of the nozzles N is eliminated, and it is expected that the shortage of the amount of discharge of the ink is eliminated.

In addition, in a case where it is determined that the third button 463 for selecting the message saying "when the printer is not used much" is pressed (N in S206), the control unit 6 causes the presentation unit 41 to display a message prompting the cleaning of the nozzles N (S212). In a situation in which the printer is not used during the predetermined period, it is considered that the frequency of using the ink decreases, and thus, the degree of thickening of the ink cannot be eliminated by the adjustment of the strength of the micro-vibration. Therefore, in the present embodiment, the control unit 6 is configured to display the message prompting the cleaning or the like without changing the selection pattern of the micro-vibration waveform. Instead of displaying the message prompting the cleaning or the like, the control unit 6 may be configured so as to end the adjustment mode and shift the mode to a cleaning execution mode.

Figure 19:
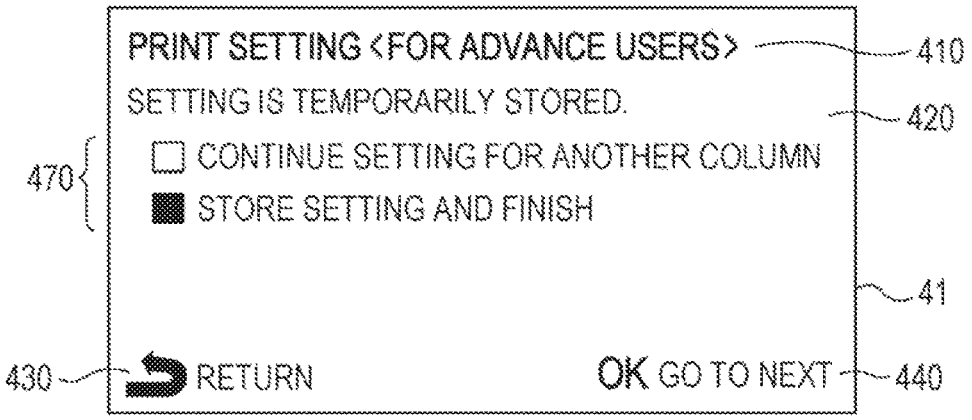
FIG. 19 is an example of a screen for selecting the continuing or finishing of the adjustment mode.

When the micro-vibration adjustment processing ends as described above, the control unit 6 switches the display on the presentation unit 41 to a display illustrated in FIG. 19 (S112). FIG. 19 is an example of a screen for selecting the continuing or finishing of the adjustment mode. As illustrated in FIG. 19, a continue/finish selection button 470 is displayed on the message portion 420 together with the message saying "the setting is temporarily stored". In a case where it is determined that the return button 430 is pressed in this stage (Y in S113), the control unit 6 returns the display on the presentation unit 41 to the usage state selection screen illustrated in FIG. 18 (S108). In a case where the user desires to continue the adjustment for another ink, the user can select the button displaying a message saying "continue setting for another column". In a case where it is determined that this button is selected and the OK button 440 is pressed (Y in S114 and Y in S115), the control unit 6 switches the display on the presentation unit 41 to the ink selection screen illustrated in FIG. 17 (S105). In a case where the user desires to end the adjustment processing, the user can select the button displaying a message saying "store the setting and finish". When it is determined that this button is selected and the OK button 440 is pressed (N in S115), the control unit 6 switches the display on the presentation unit 41 to the restore point creation screen illustrated in FIG. 20 and executes the restore point creation processing described above (S116). Here, the restore point means an address in the storage unit 62 in which the selection pattern before the execution of the above-described adjustment processing is stored.

Figure 20:
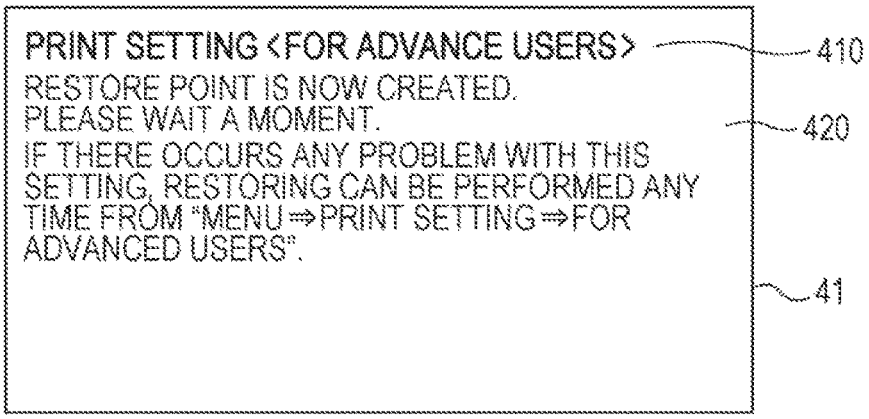
FIG. 20 is an example of a restore point creation screen.

FIG. 20 is an example of the restore point creation screen. As illustrated in FIG. 20, a message saying "restore point is now created, please wait a moment" is displayed on the message portion 420. In addition, a message indicating that the setting can be restored is displayed. It can be considered that the problem of the instability in the image in a continuous printing with a specific color as described above or the missing of image in the intermittent printing may occur due to a cause other than the strength of the micro-vibration. That is, whether or not the problem is eliminated by the adjustment processing described above cannot be known unless the printing is actually performed and checked. Therefore, in a case where the problem is not eliminated by the adjustment processing, it is needed to restore the setting to the original state. Therefore, in the present embodiment, the control unit 6 is configured to execute the restore point creation processing. For example, the control unit 6 may readably store the selection pattern before the adjustment processing described above in the storage unit 62, and create the information corresponding to the stored address as the restore point. That is, the control unit 6 readably stores the selection pattern before the execution of the adjustment processing in the storage unit 62 as the information relating to the strength of the micro-vibration before the changing.

Figure 21:
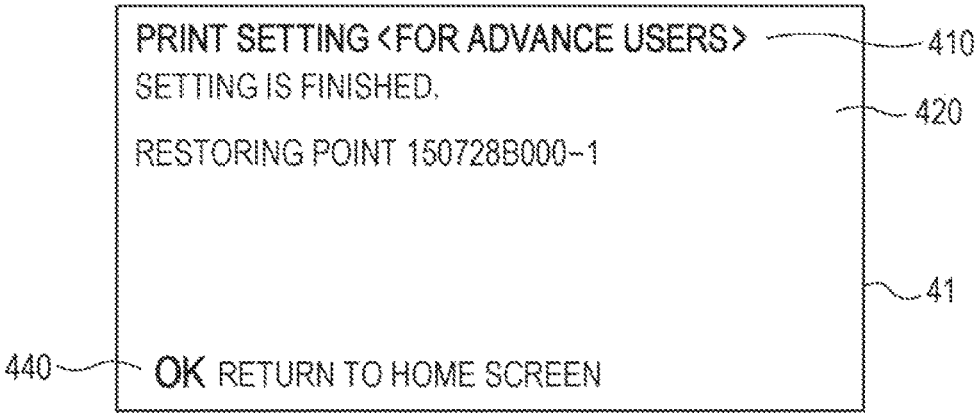
FIG. 21 is an example of a restore point display screen.

When the restore point creation processing is ended, the control unit 6 switches the display on the presentation unit 41 to the restore point display screen illustrated in FIG. 21 (S117). FIG. 21 is an example of the restore point display screen. As illustrated in FIG. 21, the restore point is displayed on the message portion 420 on the restore point display screen together with a message saying "setting is finished". The user can keep the displayed restore point and can input the restore point in the mode of executing restoring. The control unit 6 reads the selection pattern before the execution of the adjustment processing based on the input restore point and performs update processing such that the selection pattern becomes the current selection pattern. When it is determined that the OK button 440 is pressed (Y in S118), the control unit 6 ends the adjustment mode.

As described above, in the present embodiment, as the indirect information from which the ink discharge status can be estimated, the type of problem occurring ink and the usage state of such the ink and the printer is presented so as to be selected by the presentation unit 41. Then, the control unit 6 changes the strength of the micro-vibration caused by the micro-vibration waveform based on the indirect information. Therefore, according to the present embodiment, even in a case where an ink other than the standard ink is used, it possible to set the strength of the micro-vibration appropriate to that ink. As a result, even in a case where an ink other than the standard ink is used, it is possible to achieve a certain degree of image stability.

Particularly, in the present embodiment, the strength of the micro-vibration caused by the micro-vibration waveform is changed based on the indirect information such as the type of ink and the usage state of the ink and printer that are easily understandable and comparatively easily selectable by the user. Therefore, the micro-vibration caused by the micro-vibration waveform can appropriately be changed, which is not easy for a user lack of technical knowledge to directly change.

In the present embodiment, since the electric potential difference of the micro-vibration waveform or the like is not directly changed but only the selection pattern of the micro-vibration waveform is changed, the maximum amount of discharge of the ink and the minimum amount of discharge of the ink for each color during one unit period Tu are not changed. Therefore, it is possible to eliminate the problem such as the instability or missing of the image without influencing the quality of image such as a tint or brightness. In addition, in the present embodiment, since the common drive waveform signal Com is used as described above, in a case directly changing the electric potential difference of the micro-vibration waveform, the strength of the micro-vibration caused by the micro-vibration waveform cannot be differently set for each nozzle column. However, in the present embodiment, since only the selection pattern of the micro-vibration waveform is changed, it is possible to appropriately and differently set the strength of the micro-vibration caused by the micro-vibration waveform for each nozzle column.

In the present embodiment, the type of problem occurring ink and usage state of the ink and the printer are presented as indirect information from which the ink discharge status can be estimated so as to be selected by the presentation unit 41. However, the invention is not limited to the configuration described above, and thus, information other than that can appropriately be used as long as the information is indirect information from which the ink discharge status can be estimated.

B. Second Embodiment

Figure 25:
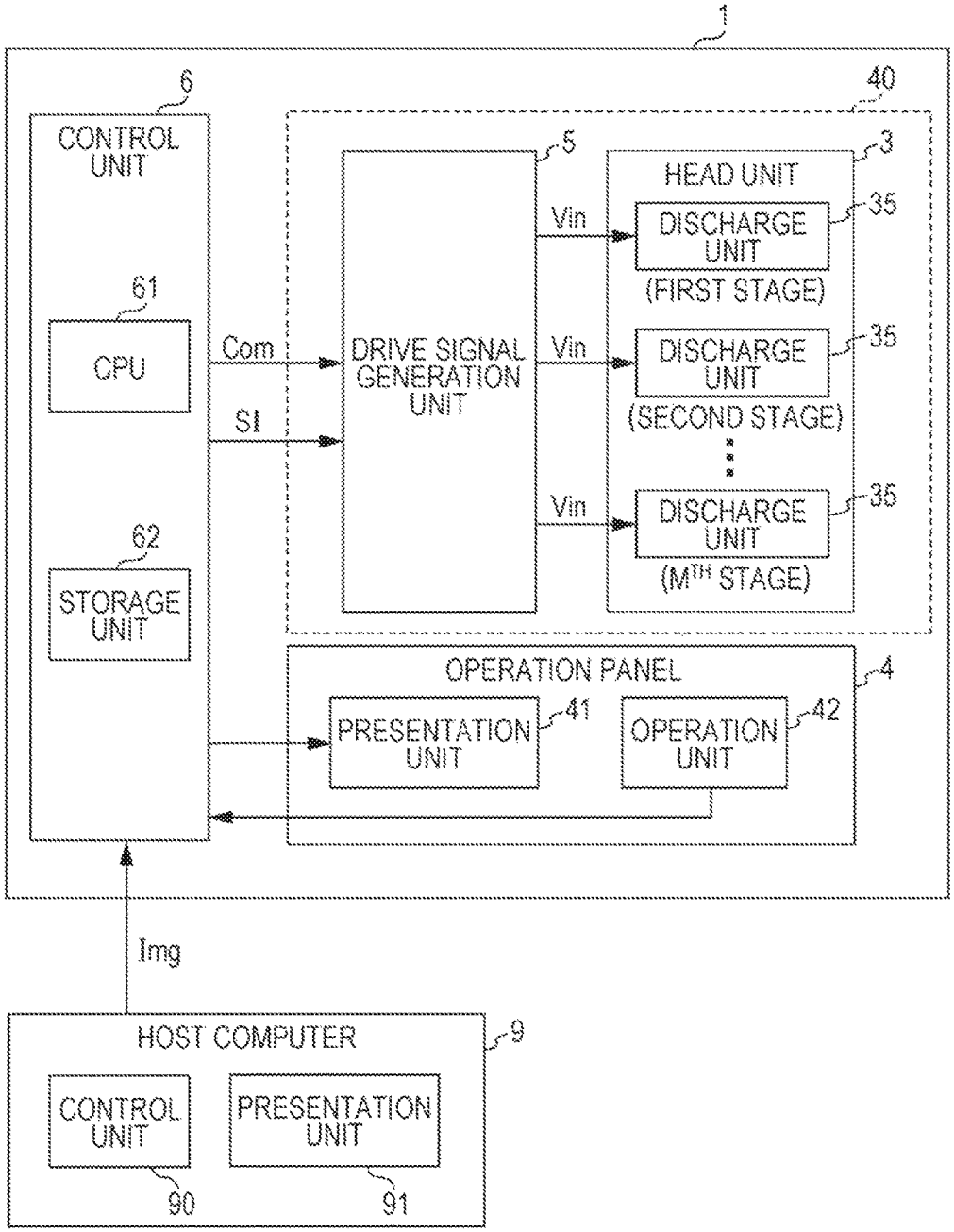
FIG. 25 is a functional block diagram illustrating an example of a configuration of an ink jet printer system in a second embodiment of the invention.
Figure 26:
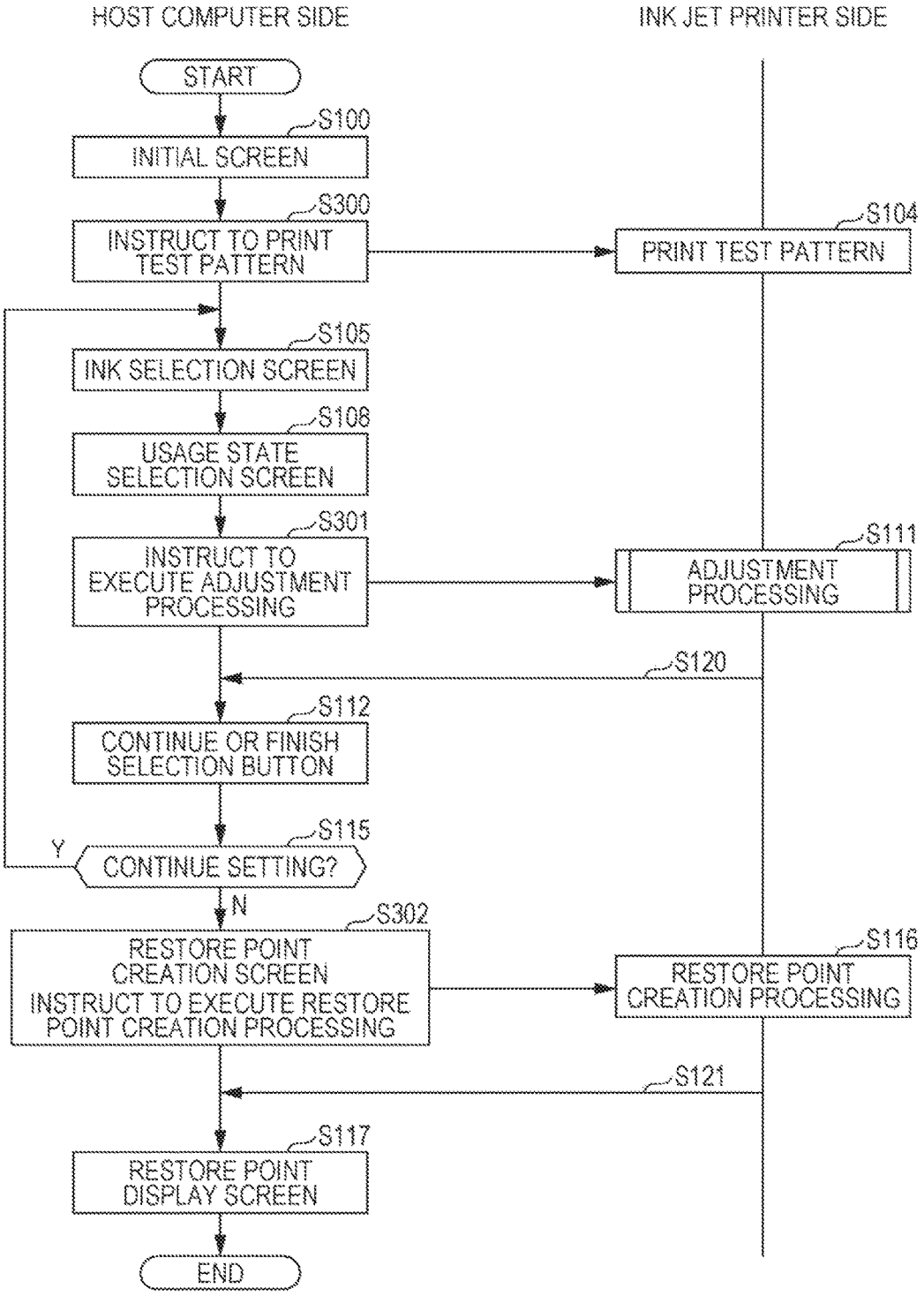
FIG. 26 is a flowchart illustrating processing by a host computer and processing by the ink jet printer.

Next, a second embodiment of the invention will be described with reference to FIG. 25 and FIG. 26. Same reference signs will be given to the elements common to those in the first embodiment and the description thereof will be omitted. FIG. 25 is a functional block diagram illustrating an example of a configuration of an ink jet printer system as an example of the liquid discharge system in the invention. The configuration of an ink jet printer 1 illustrated in FIG. 25 is similar to the ink jet printer 1 in the first embodiment illustrated in FIG. 1.

As illustrated in FIG. 25, a host computer 9 such as a personal computer or a digital camera as an example of an information processing system includes a control unit 90 and a presentation unit 91. The control unit 90 includes a CPU and a storage unit (that are not illustrated). The control unit 90 supplies image data Img to the ink jet printer 1 and outputs the indirect information info from which the ink discharge status can be estimated.

The presentation unit 91 is configured with a liquid crystal display, an organic EL display, or the like, and presents the indirect information from which the ink discharge status can be estimated. The host computer 9 includes an operation unit such as a keyboard or the like (not illustrated).

In the present embodiment, various displays described in the first embodiment with reference to FIG. 16 to FIG. 21 is performed in the presentation unit 91 in the host computer 9. That is, the presentation unit 91 functions as the presentation unit that selectably presents the indirect information from which the ink discharge status can be estimated. FIG. 26 is a flowchart illustrating processing by the host computer 9 and processing by the ink jet printer 1 in the present embodiment. The processing by the host computer 9 is almost same to the processing described in the first embodiment with reference to FIG. 23. The processing items in STEPs S300, S301, and S302 are different from the processing items illustrated in FIG. 23. In addition, the processing illustrated in FIG. 23 is executed by the control unit 6 in the ink jet printer 1. However, the processing by the host computer side illustrated in FIG. 26 is the processing executed by the control unit 90 in the host computer 9. However, in order to simplify the description, the same STEP numbers S100 to S117 are given to the processing items same to those illustrated in FIG. 23 and the detailed description thereof will be omitted. In addition, in the processing in the host computer side illustrated in FIG. 26, in order to simplify the description, the processing items relating to the return button and the OK button are omitted. The processing in the ink jet printer side illustrated in FIG. 26 is processing executed by the control unit 6 in the ink jet printer 1. The same STEP numbers S104, s111, and S116 are given to the processing items same to those illustrated in FIG. 23 and the detailed description thereof will be omitted.

Hereinafter, adjustment processing in the present embodiment for adjusting the strength of the micro-vibration caused by the micro-vibration waveform will be described with reference to FIG. 26.

In the present embodiment, the user causes the control unit 90 to execute setting program of the ink jet printer 1 by operating the keyboard or the like of the host computer 9. It is assumed that the setting program is stored in a storage unit (not illustrated) in the host computer 9. When the setting program is executed, the user can select an adjustment mode from the operation modes of the setting program by operating the keyboard or the like of the host computer 9.

When the adjustment mode is selected, the control unit 90 causes the presentation unit 91 to display an initial screen of the adjustment mode (S100). The initial screen is similar to the initial screen illustrated in FIG. 16. When it is determined that the OK button 440 is pressed, the control unit 90 instructs the ink jet printer 1 to perform the processing for printing the test pattern (S300).

When the instruction to perform the processing for printing the test pattern is received from the host computer 9, the control unit 6 in the ink jet printer 1 executes the proceeding for printing the test pattern (S104).

The control unit 90 in the host computer 9 switches the display on the presentation unit 91 to the ink selection screen (S105). The ink selection screen is similar to the ink selection screen illustrated in FIG. 17.

When it is determined that the ink selection button 450 is pressed and the OK button 440 is pressed, the control unit 90 switches the display on the presentation unit 91 to the screen for selecting the usage state of the ink or the printer when the problem occurs (S108). The screen is similar to the screen illustrated in FIG. 18. In a case where it is determined that any one button of the usage state selection buttons 460 is pressed and the OK button 440 is pressed, the control unit 90 instructs the ink jet printer 1 to execute the micro-vibration adjustment processing (S301).

When the instruction to execute the micro-vibration adjustment processing is received from the host computer 9, the control unit 6 in the ink jet printer 1 executes the micro-vibration adjustment processing (S111). The details of the micro-vibration adjustment processing are similar to the processing illustrated in FIG. 24, and the description thereof will be omitted. When the micro-vibration adjustment processing is finished, the control unit 6 notifies the host computer 9 of the finishing of the processing (S120).

When it is confirmed that the micro-vibration adjustment processing is finished in the ink jet printer 1, the control unit 90 in the host computer 9 switches the display on the presentation unit 91 to the screen for selecting the continuing or finishing of the adjustment mode (S112). The screen is similar to the screen illustrated in FIG. 19. When it is determined that the button indicating the message saying "continue setting for another column" is selected and the OK button 440 is pressed (Y in S115), the control unit 90 switches the display on the presentation unit 91 to the ink selection screen (S105). When it is determined that the button indicating the message saying "store the setting and finish" is selected and the OK button 440 is pressed (N in S115), the control unit 90 switches the display on the presentation unit 91 to the restore point creation screen (S302). In addition, the control unit 90 instructs the ink jet printer 1 to perform the point creation processing (S302). The restore point creation screen is similar to the restore point creation screen illustrated in FIG. 20.

When the instruction to execute the restore point creation processing is received from the host computer 9, the control unit 6 in the ink jet printer 1 executes the restore point creation processing (S116). The details of the restore point creation processing are similar to the processing items described with reference to FIG. 23 and the description thereof will be omitted. When the restore point creation processing is finished, the control unit 6 notifies the host computer 9 of the finishing of the processing.

When it is confirmed that the restore point creation processing is finished in the ink jet printer 1, the control unit 90 in the host computer 9 switches the display on the presentation unit 91 to the restore point display screen (S117). The restore point display screen is similar to the restore point display screen illustrated in FIG. 21. When it is determined that the OK button 440 is pressed, the control unit 90 ends the adjustment mode.

As described above, in the present embodiment, the presentation unit 91 functions as a presentation unit that selectably presents the indirect information from which the ink discharge status can be estimated. In addition, the control unit 90 functions as an output unit that outputs the indirect information selected in the presentation unit 91 to the ink jet printer 1.

Therefore, in the present embodiment also, even in a case where an ink other than the standard ink is used, it possible to set the strength of the micro-vibration appropriate to that ink. As a result, even in a case where an ink other than the standard ink is used, it is possible to achieve a certain degree of image stability. Other effects can be obtained similar to the first embodiment.

C. Modification Example

Each of the above embodiments can be variously modified. Specific modified embodiments will be exemplified as described below. Two or more aspects arbitrarily selected from the example described below can appropriately be combined within the range of being not mutually contradictory.

Modification Example 1

Figure 27:
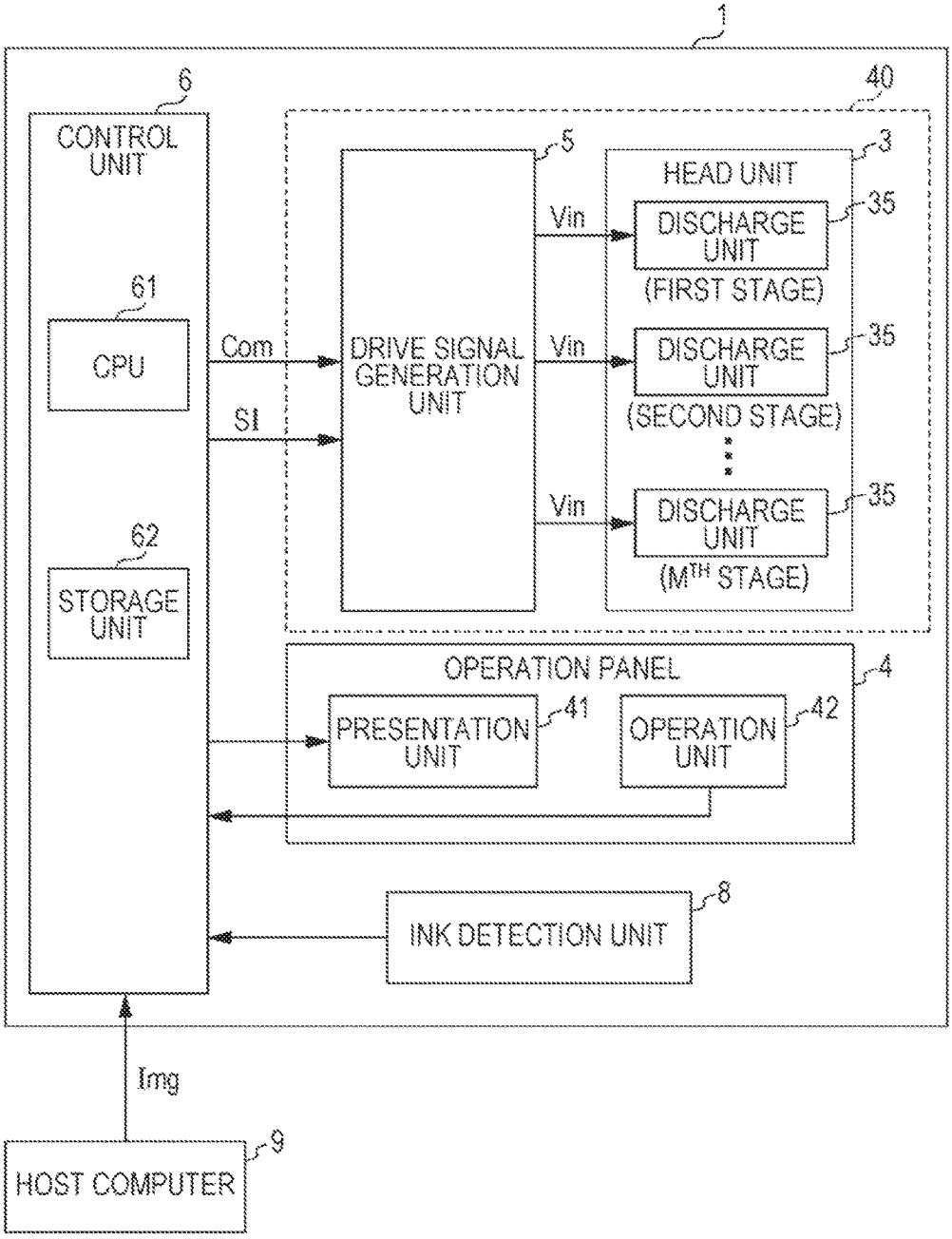
FIG. 27 is a block diagram illustrating a configuration of the ink jet printer in a modification example 1.

In each embodiment described above, the configuration is described, in which the micro-vibration adjustment processing is started by user's selection of the adjustment mode in the ink jet printer 1. However, the invention is not limited to such the configuration, and the micro-vibration adjustment processing may be started in a case where the ink jet printer 1 detects a predetermined situation. For example, as illustrated in FIG. 27, the ink jet printer 1 may include an ink detection unit 8. FIG. 27 is a block diagram illustrating a configuration of an ink jet printer 1 in the modification example 1. The control unit 6 can start the micro-vibration adjustment processing when it is detected by the ink detection unit 8 that an ink other than the standard ink is used. That is, the control unit 6 selectably presents the above-described indirect information on the presentation unit 41. For example, an IC chip or the like for identifying an ink cartridge is mounted on the liquid container 24, and the fact that an ink other than the standard ink is used may be detected based on information read by the ink detection unit 8 from the IC chip or the like. In this case, the ink detection unit 8 functions as a first liquid detection unit that detects that an ink other than the standard ink is used. In addition, the control unit 6 reads the information from the IC chip or the like in the liquid container 24 via the ink detection unit 8 and the fact that an ink other than the standard ink is used may be detected based on the information. In this case, the control unit 6 functions as the first liquid detection unit that detects that an ink other than the standard ink is used. When an ink other than the standard ink is used is detected, the control unit 6 selectably presents the above-described indirect information on the presentation unit 41.

In addition, in some cases, an amount of ink remaining in the liquid container 24 can be read from the IC chip or the like in the liquid container 24. In this case, the micro-vibration adjustment processing may be started when the ink detection unit 8 or the control unit 6 detects needs for the exchange or the replenishment of the ink based on the amount of remaining ink read by the IC chip or the like. When the ink detection unit 8 detects needs for the exchange or the replenishment of the ink, or the needs for the exchange or the replenishment of the ink is detected via the ink detection unit 8, the control unit 6 selectably presents the above-described indirect information on the presentation unit 41. In this case, the ink detection unit 8 and the control unit 6 function as a second liquid detection unit that detects the needs for the exchange or the replenishment of the liquid.

In addition, the ink detection unit 8 may be included in the ink jet printer 1 in the ink jet printer system illustrated in FIG. 25. In this case, the control unit 6 or the ink detection unit 8 in the ink jet printer 1 detects that an ink other than the standard ink is used, or detects the needs for the exchange or the replenishment of the ink. When the exchange or the replenishment of the ink is needed, there is possibility that an ink other than the standard ink is used. Therefore, the control unit 6 notifies the host computer 9 of the fact that those detections are performed. When it is confirmed that an ink other than the standard ink is used or the exchange or the replenishment of the ink is performed in the ink jet printer 1, the control unit 90 in the host computer 9 starts the adjustment processing. That is, the control unit 90 causes the presentation unit 91 to selectably present the above-described indirect information. The configuration may be as described above.

According to the present modification example also, in a case where an ink other than the standard ink is used, it is possible to set the strength of the micro-vibration appropriate to the ink. As a result, even in a case where an ink other than the standard ink is used, it is possible to achieve a certain degree of image stability.

Modification Example 2

Figure 28:
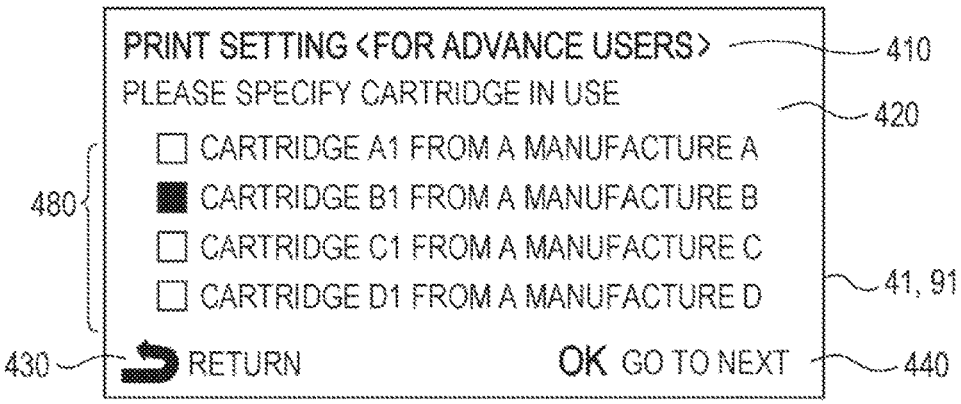
FIG. 28 is an example of a screen for selecting information indicating a specific ink in a modification example 2.

Even in a case where an ink other than the standard ink is used, in a case where the characteristics such as viscosity of the ink can be checked in advance by experiment or the like, the micro-vibration waveform and the selection pattern of the micro-vibration waveform corresponding to the characteristics of the ink may be stored in advance as a table. In addition, any one of the micro-vibration waveform and the selection pattern of the micro-vibration waveform corresponding to the characteristics of the ink may be stored in advance as a table. In this case, before the ink selection screen illustrated in FIG. 17, information indicating a specific ink may be presented on the presentation unit 41 or the presentation unit 91 as the indirect information from which the ink discharge status can be estimated as illustrated in FIG. 28. FIG. 28 is an example of a screen for selecting the information indicating the specific ink in the modification example 2. In the example illustrated in FIG. 28, a cartridge selection button 480 is displayed on the message portion 420 as the information indicating the specific ink. The cartridge selection button 480 is displays as, for example, a "cartridge A1 from a manufacture A", a "cartridge B1 from a manufacture B", a "cartridge C1 from a manufacture C", and a "cartridge D1 from a manufacture D". The micro-vibration waveforms and the selection patterns of the micro-vibration waveforms corresponding to these cartridges are stored in advance as a table, and then, the adjustment of the strength of the micro-vibration caused by the micro-vibration waveform is performed above-described. Alternatively, any one of the micro-vibration waveforms and the selection patterns of the micro-vibration waveforms corresponding to these cartridges are stored in advance as a table, and then, the adjustment of the strength of the micro-vibration caused by the micro-vibration waveform is performed above-described. According to the present modification example, it is possible to further appropriately adjust the strength of the micro-vibration caused by the micro-vibration waveform.

Modification Example 3

Figure 29:
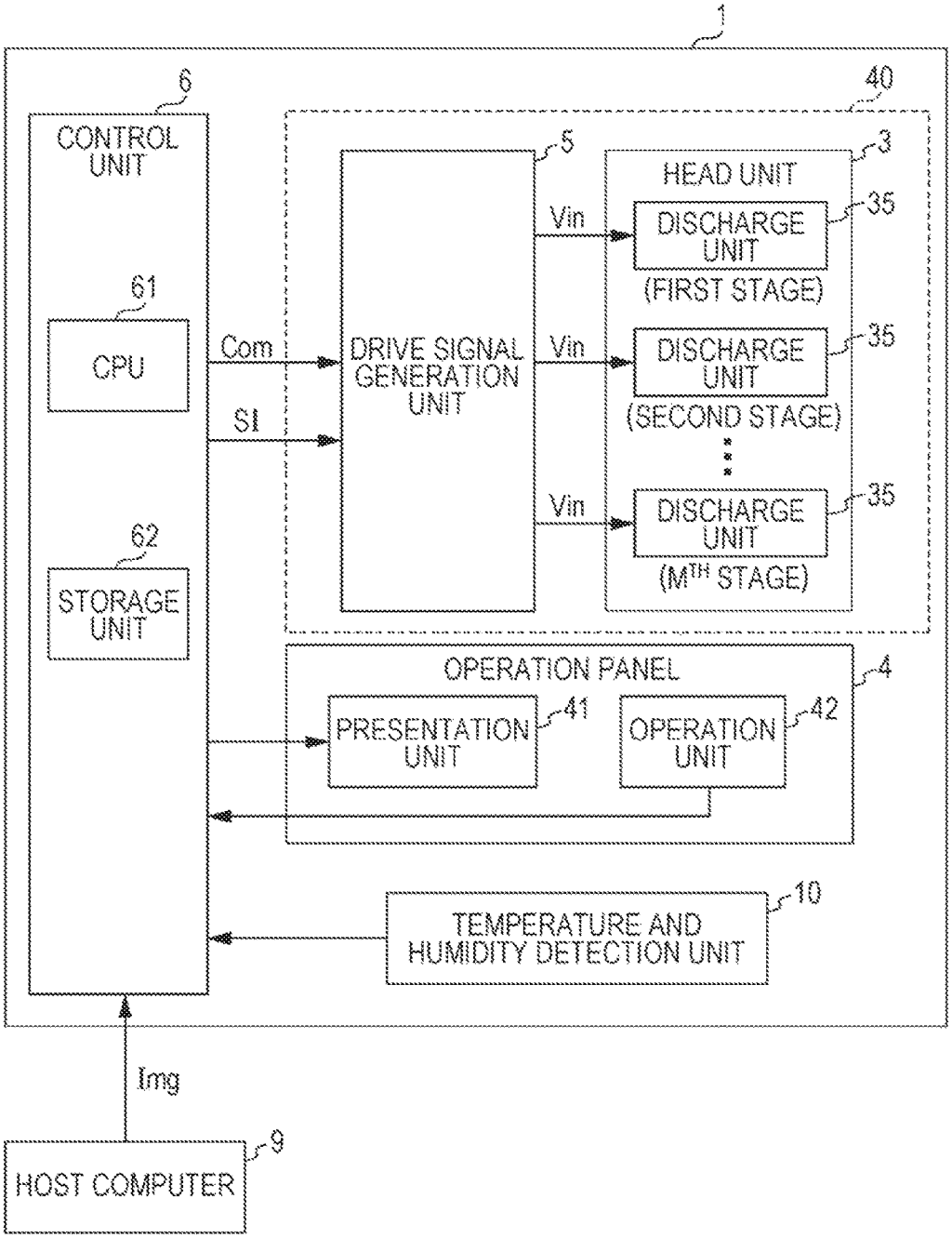
FIG. 29 is a block diagram illustrating configuration of the ink jet printer in a modification example 3.

The ink jet printer 1 may further include a detection unit that detects changes in the external environment. For example, as illustrated in FIG. 29, the ink jet printer 1 may include a temperature and humidity detection unit 10. FIG. 29 is a block diagram illustrating a configuration of the ink jet printer 1 in a modification example 3. Alternatively, the ink jet printer 1 illustrated in FIG. 25 may include the temperature and humidity detection unit 10. In this case, the control unit 6 may perform changing of the strength of the micro-vibration caused by the micro-vibration waveform when the control unit 6 or the temperature and humidity detection unit 10 detects the change of the temperature and the humidity. Alternatively, the control unit 6 may perform changing of the strength of the micro-vibration caused by the micro-vibration waveform when the control unit 6 or the temperature and humidity detection unit 10 detects the change of any one of the temperature and the humidity. That is because there is a possibility that the viscosity characteristics of the ink may be changed when the external environment such as the temperature and the humidity is changed. In this case, in this case, the control unit 6 or the temperature and humidity detection unit 10 detects as a detection unit that detects the changes in the external environment. The external environment may be other than the temperature and the humidity. In addition, in a case where the changes in the external environment is detected in the ink jet printer 1, the control unit 6 may notify the host computer 9 of the detection, and the control unit 90 may present the screen of the adjustment mode for adjusting the micro-vibration on the presentation unit 91. In addition, the adjustment of the micro-vibration performed when the changes in the external environment is detected may be performed not only by changing the selection pattern of the micro-vibration waveform but also by changing the electric potential difference or the pulse width of the micro-vibration waveforms. According to the present modification example, even in a case where the external environment is changed, it is possible to appropriately perform the adjustment of the micro-vibration.

Modification Example 4

Figure 30:
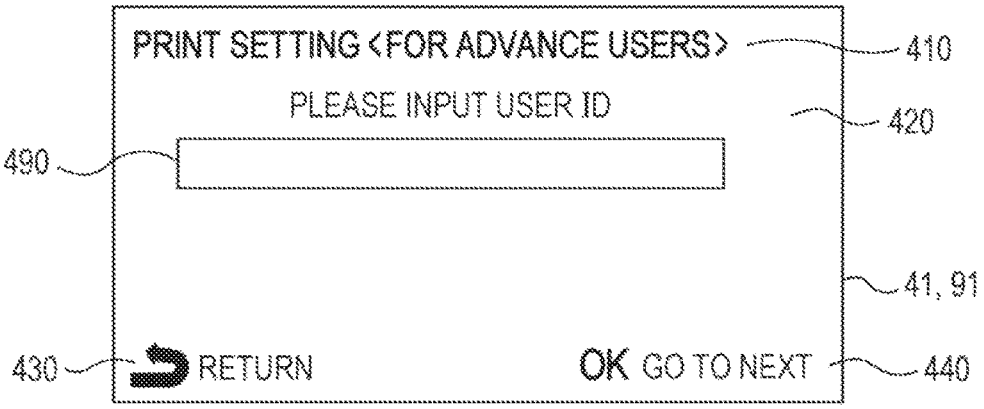
FIG. 30 is an example of a screen for inputting information for identifying a user in a modification example 4.

In a case where an ink jet printer 1 is used by a plurality of users, it is considered that the ink in use may be different for each other according the users. Therefore, the ink jet printer 1 or the host computer 9 may include an identification unit that identifies the users, and the indirect information displayed on the presentation unit 41 or the presentation unit 91 may be switched according to the users. For example, as illustrated in FIG. 30, a user ID input field 490 is displayed on the presentation unit 41 or the presentation unit 91 as the information for identifying the user. FIG. 30 is an example of the screen for inputting the information for identifying the user in the modification example 4. In this case, the control unit 6 in the ink jet printer 1 or the control unit 90 in the host computer 9 functions as the identification unit. In this case, for example, it can be considered that the processing for changing the information specifying the cartridges displayed as the cartridge selection button 480 as illustrated in FIG. 28 can be performed for each user. According to the present modification example, it is possible to further appropriately perform the adjustment of the micro-vibration according to the users.

Modification Example 5

In the embodiments and the modification examples described above, the configuration in which a single drive waveform signal Com is used is described. However, the invention is not limited to such configuration. For example, the configuration may include a drive waveform signal ComA including the drive waveform PA and a drive waveform signal ComB including the micro-vibration waveform PlsA or the micro-vibration waveform PlsB. In this case, the drive waveform signal ComA and the drive waveform signal ComB may appropriately be switched according to the size of the dots and the situation of each dot such as the record or non-record. In addition, other than the drive waveform signal ComB including the micro-vibration waveform PlsA, a drive waveform signal ComC including the micro-vibration waveform PlsB may be used. In this case, the drive waveform signal ComA, the drive waveform signal ComB, and the drive waveform signal ComC may appropriately be switched according to the size of the dots and the situation of each dot such as the record or non-record. Furthermore, a plurality of drive waveform signals having drive waveforms different from each other or a plurality of drive waveform signals having micro-vibration waveforms different from each other may appropriately be switched. In any cases, the drive waveform signals targeted for switching may appropriately be selected such that the strength of the micro-vibration caused by the micro-vibration waveform can be changed according to the ink discharge status estimated from the above-described indirect information.

Modification Example 6

In the embodiments and the modification examples described above, the configuration is described, in which the strength of the micro-vibration caused by the micro-vibration waveform is changed by changing the selection pattern of the drive waveform signal Com. However, the invention is not limited to such configuration. The micro-vibration waveform itself may be changed based on the above-described indirect information such as the electric potential difference and the pulse width of the micro-vibration waveform, or any one of the electric potential difference and the pulse width of the micro-vibration waveform.

Modification Example 7

In the embodiments and the modification examples described above, the invention is applied to the ink jet printer 1 that can express four gradations such as the large dots, the middle dots, the small dots, and the non-record. However, the invention is not limited to the example, and can be applied to the ink jet printer 1 of two gradations such as the record and non-record. Alternatively, the invention can be further applied to the ink jet printer 1 of multi-gradations.

Modification Example 8

In the embodiments and the modification examples described above, a serial printer is used as an example of the ink jet printer in the description. However, a line printer may be used, in which the main scanning direction of the head unit 3 and the sub-scanning direction where the medium 22 is transported are the same.

The entire disclosure of Japanese Patent Application No. 2016-040737, filed Mar. 3, 2016 is expressly incorporated by reference herein.

What is claimed is:

1. A liquid discharge apparatus comprising:

a piezoelectric element that is deformed when a drive signal is applied;

a nozzle that discharges a liquid by the deformation of the piezoelectric element;

a drive signal generation unit that generates a drive signal including a micro-vibration waveform which causes the piezoelectric element to micro-vibrate such that the liquid is not discharged from the nozzle in a case of being applied to the piezoelectric element as the drive signal and a drive waveform which deforms piezoelectric element such that the liquid is discharged from the nozzle in a case of being applied to the piezoelectric element as the drive signal;

a presentation unit that is configured to selectably present indirect information to a user and to receive input from the user selecting the indirect information; and a control unit that changes a strength of the micro-vibration caused by the micro-vibration waveform based on the indirect information selected on the presentation unit.

2. The liquid discharge apparatus according to claim 1, wherein the presentation unit presents information that specifies types of the liquid as the indirect information from which the liquid discharge status can be estimated.

3. The liquid discharge apparatus according to claim 1, wherein the presentation unit presents information from which an amount degree of discharge of the liquid can be estimated, as the indirect information from which the liquid discharge status can be estimated.

4. The liquid discharge apparatus according to claim 1, wherein the presentation unit presents information relating to a frequency of using the liquid in a predetermined period as the indirect information from which the liquid discharge status can be estimated.

5. The liquid discharge apparatus according to claim 1, further comprising;

a first liquid detection unit that detects that a liquid other than a standard liquid is used, wherein, in a case where the first liquid detection unit detects that a liquid other than the standard liquid is used, the presentation unit selectably presents the indirect information.

6. The liquid discharge apparatus according to claim 1, wherein the presentation unit selectably presents information indicating the specific liquid as the indirect information from which the liquid discharge status can be estimated.

7. The liquid discharge apparatus according to claim 1, further comprising:

a second liquid detection unit that detects an exchange or a replenishment of the liquid, wherein, in a case where the exchange or the replenishment of the liquid is detected by the second liquid detection unit, the presentation unit selectably presents the indirect information.

8. The liquid discharge apparatus according to claim 1, wherein the control unit readably stores information relating to the strength of the micro-vibration before the change.

9. The liquid discharge apparatus according to claim 1, further comprising:

a detection unit that detects a change in the external environment, wherein the control unit changes the strength of the micro-vibration caused by the micro-vibration waveform according to the change in the external environment detected by the detection unit.

10. The liquid discharge apparatus according to claim 1, further comprising:

an identification unit that identifies a user, wherein the presentation unit appropriately switches the presented indirect information according to the user identified by the identification unit.

11. A liquid discharge system comprising:

a liquid discharge apparatus; and an information processing system capable of communicating with the liquid discharge apparatus, wherein the liquid discharge apparatus includes a piezoelectric element that is deformed when a drive signal is applied, a nozzle that discharges a liquid by the deformation of the piezoelectric element, a drive signal generation unit that generates a drive signal including a micro-vibration waveform which causes the piezoelectric element to micro-vibrate such that the liquid is not discharged from the nozzle in a case of being applied to the piezoelectric element as the drive signal and a drive waveform which deforms the piezoelectric element such that the liquid is discharged from the nozzle in a case of being applied to the piezoelectric element as the drive signal, and a control unit, and wherein the information processing system includes a presentation unit that is configured to selectably present indirect information to a user and receive input from a user selecting the indirect information, an output unit that outputs the indirect information selected on the presentation unit to the liquid discharge apparatus, and wherein the control unit changes a strength of the micro-vibration caused by the micro-vibration waveform based on the indirect information.

* * * * *